US005192033A

United States Patent [19]

Pipes

[11] Patent Number: 5,192,033

[45] Date of Patent: Mar. 9, 1993

[54] APPARATUS FOR MOVING ROLLS FROM A LOADING STATION TO AN UNWINDING STATION AND FOR MOVING EMPTY ROLL CORES FROM THE UNWINDING STATION TO THE LOADING STATION

[75] Inventor: George R. Pipes, Salt Lake City, Utah

[73] Assignee: Eaton-Kenway, Inc., Salt Lake City, Utah

[21] Appl. No.: 664,180

[22] Filed: Feb. 26, 1991

[51] Int. Cl.[5] ..... B65H 19/30; B65H 16/02; B21C 47/24

[52] U.S. Cl. ..... 242/58.6; 242/79; 242/57; 242/68.4; 414/911

[58] Field of Search ..... 242/58.6, 79, 54 R, 242/68.4, 57; 414/911

[56] References Cited

U.S. PATENT DOCUMENTS

| | | | |
|---|---|---|---|
| 2,535,815 | 12/1950 | Seeger | 242/58.6 |
| 2,973,914 | 3/1961 | Beninger et al. | 242/58 |
| 3,172,613 | 3/1965 | Simons et al. | 242/58.2 |
| 3,276,711 | 10/1966 | Martin | 242/58.6 |
| 4,129,265 | 12/1978 | Bandy, Jr. | 242/58.2 |
| 4,431,140 | 2/1984 | Tetro | 242/64 X |
| 4,466,577 | 8/1984 | Focke et al. | 242/58 |
| 4,537,368 | 8/1985 | Radmore et al. | 242/58.6 |
| 4,773,609 | 9/1988 | Steffen et al. | 242/57 X |
| 4,881,695 | 11/1989 | Beisswanger | 242/58.6 X |
| 5,002,235 | 3/1991 | Greer et al. | 242/79 X |

*Primary Examiner*—Daniel P. Stodola
*Assistant Examiner*—John Rollins
*Attorney, Agent, or Firm*—F. M. Sajovec

[57] ABSTRACT

A material handling apparatus is used to sequentially move rolls of material having cores from a loading station to an unwinding station and to sequentially move empty roll cores from the unwinding station. The apparatus includes a generally H-shaped transfer frame having spindle assemblies at opposite ends of the transfer frame. When spindle assemblies at one end of the frame have engaged the core of a first roll at the loading station, the frame is pivoted about the central axes of the spindle assemblies while the first roll remains stationary at the loading station. This pivotal movement moves an empty core along an arcuate path from the unwinding station to a position above the stationary first roll at the loading station. The first roll is then moved from the loading station to the unwinding station. The spindle assemblies have wheels which roll along rails during movement of the first roll from the loading station to the unwinding station. As the first roll moves along the rails from the loading station to the unwinding station, the frame is pivoted about the central axis of the core of the first roll and the empty core is moved downwardly to the loading station. In order to position a roll with its core horizontal, photoelectric sensors are used to detect when opposite end portions of the core are at the same level.

74 Claims, 9 Drawing Sheets

7
106
130
86
20
198
74
212
72
112
214
44
54
204
34
124
202
208
206
26
88
68
94
100
146
230
144
48
50
56
236
228
7

APPARATUS FOR MOVING ROLLS FROM A LOADING STATION TO AN UNWINDING STATION AND FOR MOVING EMPTY ROLL CORES FROM THE UNWINDING STATION TO THE LOADING STATION

BACKGROUND OF THE INVENTION

An improved apparatus and method are used in the handling of rolls of material. According to one aspect of the invention, the apparatus and method are used to sequentially move rolls of material from a loading station to an unwinding station and to sequentially move empty roll cores from the unwinding station back to the loading station. According to another aspect of the invention, the rolls of material are supported on wheels as they move from a loading station to an unwinding station. In accordance with still another aspect of the invention, the rolls are positioned with central axes of cores of the rolls in a horizontal orientation.

During the manufacture of the relatively small rolls of toilet tissue which are commonly sold at retail stores, very large storage rolls of toilet tissue are formed. The large storage rolls of toilet tissue may have a diameter of approximately 2,540 mm and a length of axial extent of approximately 2,650 mm. These large storage rolls of toilet tissue have a weight of approximately 2,000 kg.

During the manufacturing process, the toilet tissue is unwound from the storage rolls and rolled onto long rolls to form what is referred to as logs of toilet tissue. These logs of toilet tissue may have a diameter of approximately 100 to 130 mm and a length or axial extent of approximately 2,650 mm. The relatively long logs are cut into segments to form relatively small rolls of toilet tissue having a length of approximately 100 to 110 mm. These relatively small rolls of toilet tissue are subsequently sold at retail outlets.

The handling of the large and heavy storage rolls of toilet tissue is difficult due to both the size and the weight of the storage rolls. In addition, the large storage rolls of toilet tissue usually do not have a cylindrical configuration. The noncylindrical configuration of the storage rolls of toilet tissue may result from an uneven layering of the compressible toilet tissue material as it is wound onto the cores of the storage rolls. In addition, the weight of the toilet tissue tends to cause the material in the rolls to sag or deform while the rolls are being stored.

Once the toilet tissue has been unwound from the core of a storage roll, it is necessary to return the empty core for reuse in association with subsequently formed storage rolls of toilet tissue. Although the empty storage roll core is no where near as heavy as a storage roll of toilet tissue, the empty cores are relatively heavy since they must be strong enough to hold the weight of the toilet tissue on the storage roll.

SUMMARY OF THE INVENTION

Although the present invention provides a material handling apparatus and a method which are advantageously used in conjunction with the movement of large rolls of toilet tissue having cores, it is contemplated that the material handling apparatus and method of the present invention can be used with many different types of material. Thus, the material handling apparatus and method of the present invention can be used to handle rolls of paper to be fed to a printing press or other device or to handle rolls of cloth to be fed to an apparatus during a manufacturing process. Therefore, the invention should not be considered as being limited to the handling of rolls of any particular type of material. However, it is believed that the invention will be particularly advantageous in handling large noncylindrical rolls of material.

The material handling apparatus may include a transfer frame having a first end portion for holding a first roll by its core during movement of the first roll from a loading station to an unwinding station. The first end portion of the transfer frame also holds the empty core of the first roll during movement of the empty core from the unwinding station back to the loading station. The transfer frame has a second end portion which holds a second roll by its core during movement of the second roll from the loading station to the unwinding station. The second end portion of the transfer frame also holds the empty core of the second roll during movement of the empty core of the second roll from the unwinding station back to the loading station.

To facilitate movement of a roll from the loading station to the unwinding station, wheels may be connected with opposite ends of the core of a roll. During movement of the roll from the loading station to the unwinding station, the wheels roll along rails extending from the loading station to the unwinding station. During movement of the empty core of the roll from the unwinding station to the loading station, the wheels are disengaged from the rails Once the material has been unwound from a core at the unwinding station, the empty core may be moved to a position above the loading station. As the next roll of material is moved from the loading station to the unwinding station, the empty core is moved downwardly to the loading station. During this movement the roll from the loading station to the unwinding station and the movement of an empty core from the unwinding station back to the loading station, the transfer frame is turned end-for-end with a roll at one end of the transfer frame and an empty core at the other end of the transfer frame.

When the apparatus and method of the present invention are used to handle noncylindrical rolls of material, the core of the noncylindrical roll is moved to a horizontal orientation before the core is engaged by the transfer frame. A pair of lift assemblies are provided to support opposite ends of the roll. Each of the lift assemblies is operated to move one end of the roll until a sensor assembly detects that an end of a roll core has been moved to a predetermined level.

BRIEF DESCRIPTION OF THE DRAWINGS

The foregoing and other features of the present invention will become apparent to one skilled in the art upon a consideration of the following description of the invention with reference to the accompanying drawings, wherein.

DESCRIPTION OF ONE SPECIFIC PREFERRED EMBODIMENT OF THE INVENTION

General Description

Figure 1:
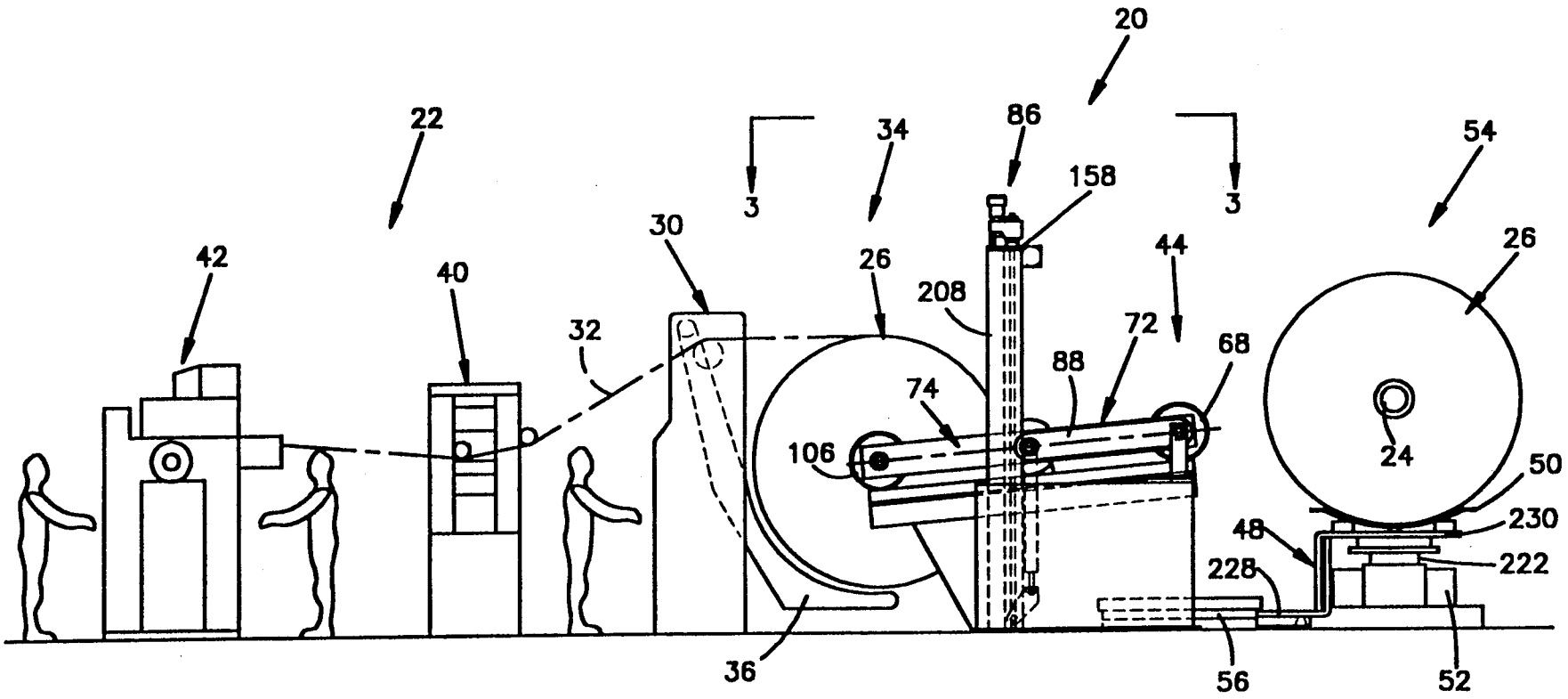
FIG. 1 is a schematic side elevational view illustrating the relationship between a known rewinder assembly and a material handling apparatus constructed and operated in accordance with the present invention.

A material handling apparatus 20 constructed and operated in accordance with the present invention is illustrated in FIG. 1 in association with a rewind assembly 22 of known construction. Although the material handling apparatus 20 could be utilized in many different environments in association with many different types of materials, the material handling apparatus 20 is illustrated and described in conjunction with a known process of manufacturing toilet tissue. During the manufacturing of the toilet tissue, the toilet tissue is wound around relatively large cylindrical cores 24 to form very large storage rolls 26 which usually have a noncylindrical configuration.

The rewind assembly 22 rewinds the toilet tissue from a large storage roll 26 onto a very long roll or log (not shown) having a relatively small diameter which is the same as the diameter of rolls of toilet tissue which are commonly available at retail outlets. This relatively small and long roll has a length which is the same as the axial length of the storage roll 26. The relatively long roll or log is cut at a plurality of locations to form a plurality of rolls of toilet tissue of a size corresponding to the size of the rolls of toilet tissue commonly available at commercial outlets.

The rewind assembly 22 (FIG. 1) operates in a known manner and includes a infeed unit 30 which receives a web 32 of toilet tissue from a storage roll 26 disposed at an unwinding station 34. The infeed unit 30 includes a belt drive assembly 36 which engages the periphery of a noncylindrical storage roll 26 of toilet tissue at the unwinding station 34 to rotate the storage roll about the central axis of its core 24. As the storage roll 26 is rotated at the unwinding station 34, the web 32 of toilet tissue is drawn into the infeed unit 30.

From the infeed unit 30, the web 32 of toilet tissue moves through an intermediate unit 40. The intermediate unit 40 is operable to emboss and/or perforate the web 32 in a known manner. The web 32 then moves into a rewind unit 42.

The rewind unit 42 winds the web 32 to form the relatively long rolls or logs having a diameter corresponding to the diameter of rolls of toilet tissue which are commonly available at retail outlets. The relatively long log or roll in the rewind unit 42 has a length which is the same as the width of the web 32 and axial length of the storage roll 26. In accordance with known practice, the relatively long log or roll from the rewind unit 42 is cut into a plurality of segments to form rolls of toilet tissue having a size corresponding to the size of rolls of toilet tissue commonly available at commercial outlets.

The material handling apparatus 20 (FIG. 1) sequentially moves the relatively large storage rolls 26 of toilet tissue from a loading station 44 to the unwinding station 34. Once the web 32 of toilet tissue has been unwound from a storage roll 26, only the empty core 24 remains. The material handling apparatus 20 also sequentially moves empty storage roll cores 24 from the unwinding station 34 after the toilet tissue has been unwound from the cores at the unwinding station. The empty storage roll cores 24 are advantageously moved back to the loading station 44.

The storage rolls 26 of toilet tissue are relatively large and heavy. Thus, the storage rolls 26 have a diameter of approximately 2,540 mm, a length of 2,650 mm and a weight of approximately 2,000 kg. The handling of the storage rolls 26 by the material handling apparatus 20 is complicated by the fact that the storage rolls 26 usually do not have a cylindrical configuration.

The noncylindrical configuration of the storage roll 26 may be due to many different factors, including an uneven layering of toilet tissue on the storage roll cores 24 as the toilet tissue is wound on the core. In addition, while the storage roll 26 of toilet tissue is being stored, the toilet tissue tends to sag under the influence of its own weight. Thus, even though the core 24 is cylindrical, the storage roll 26 will probably have a noncylindrical configuration. Although the material handling apparatus 20 is advantageously used in conjunction with the large, noncylindrical storage rolls 26 of toilet tissue, the apparatus may be used in conjunction with the handling of rolls of other materials.

The material handling apparatus 20 (FIG. 1) includes a transfer car 48. The transfer car 48 picks up a cradle 50 and a storage roll 26 from an automatic guided vehicle 52 at a pickup and delivery station 54. The transfer car 48 moves toward the left (as viewed in FIG. 1) to move the storage roll 26 from the pickup and delivery station 54 to the loading station 44. At the loading station 44, a pair of lift assemblies 56 and 58 (FIG. 7) engage the cradle 50 to lift the cradle off of the transfer car 48.

Figure 9:
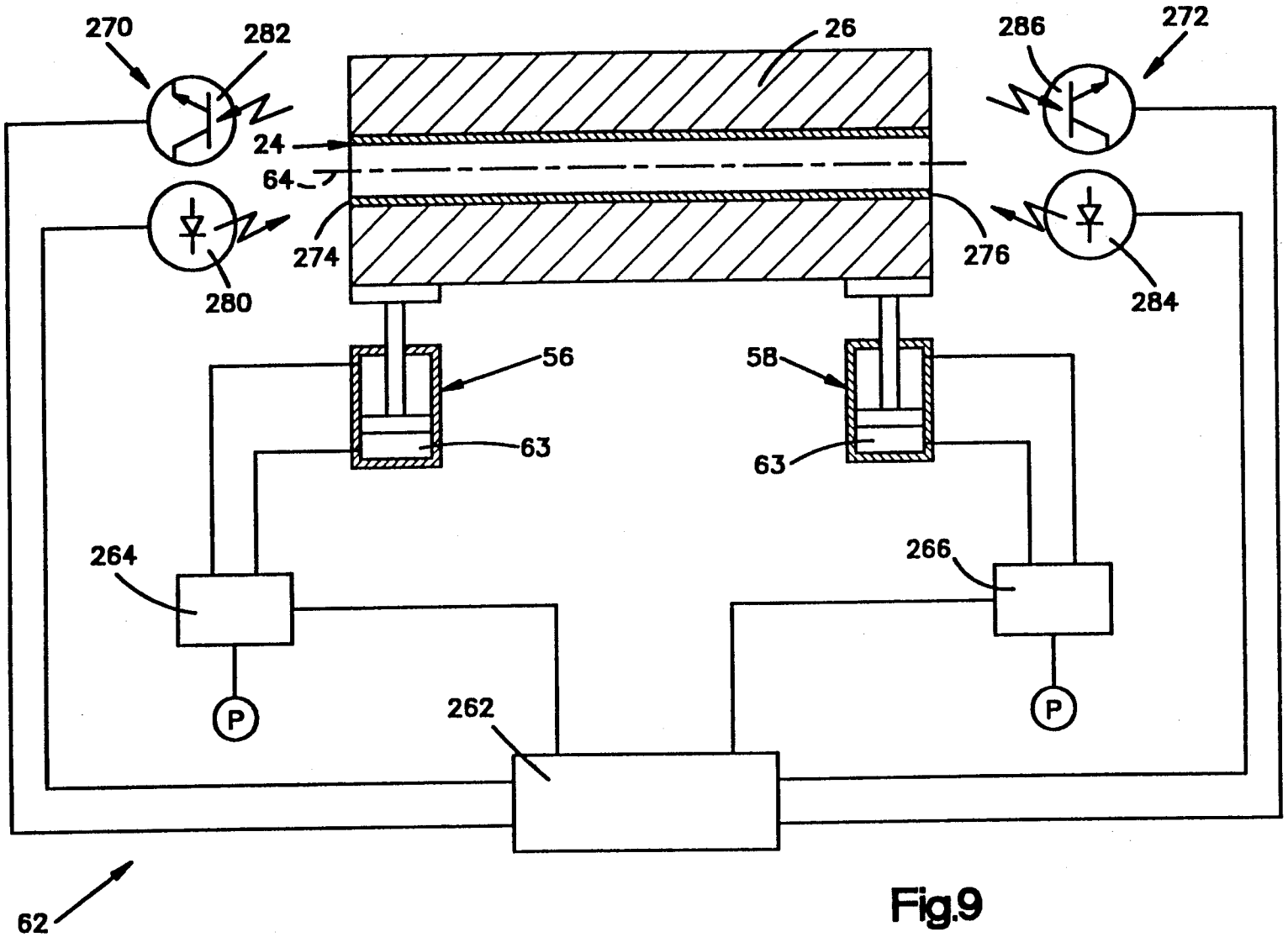
FIG. 9 is a highly schematicized illustration depicting the relationship between a roll of material and a control apparatus utilized to control the operation of lift assemblies to position the roll of material with a central axis of its core horizontal.

Once the cradle 50 has been engaged by the lift assemblies 56 and 58, the transfer car 48 moves back to the pickup and delivery station 54 (FIG. 1). A lift control assembly 62 (FIG. 9) then effects operation of motors 63 in the scissors-type lift assemblies 56 and 58 to position the noncylindrical roll 26 with a longitudinal central axis 64 of the roll core 24 horizontal. Once this has been done, the lift control assembly 62 effects operation of the motors 63 in the lift assemblies 56 and 58 to move the storage roll 26 to a loading position with the central axis 64 of the roll core 24 horizontal.

Figure 2:
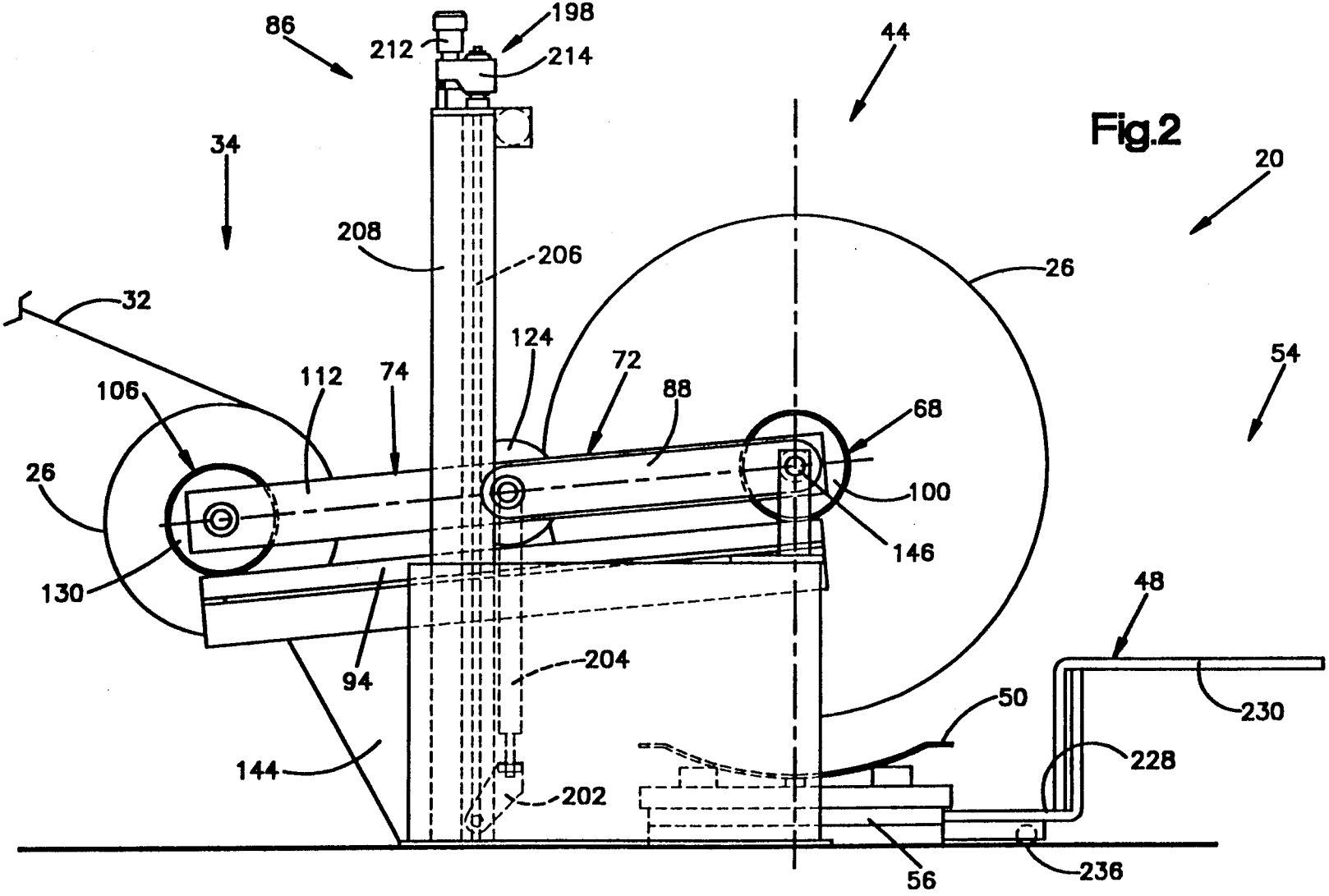
FIG. 2 is an enlarged side elevational view of the material handling apparatus of FIG. 1.
Figure 7:
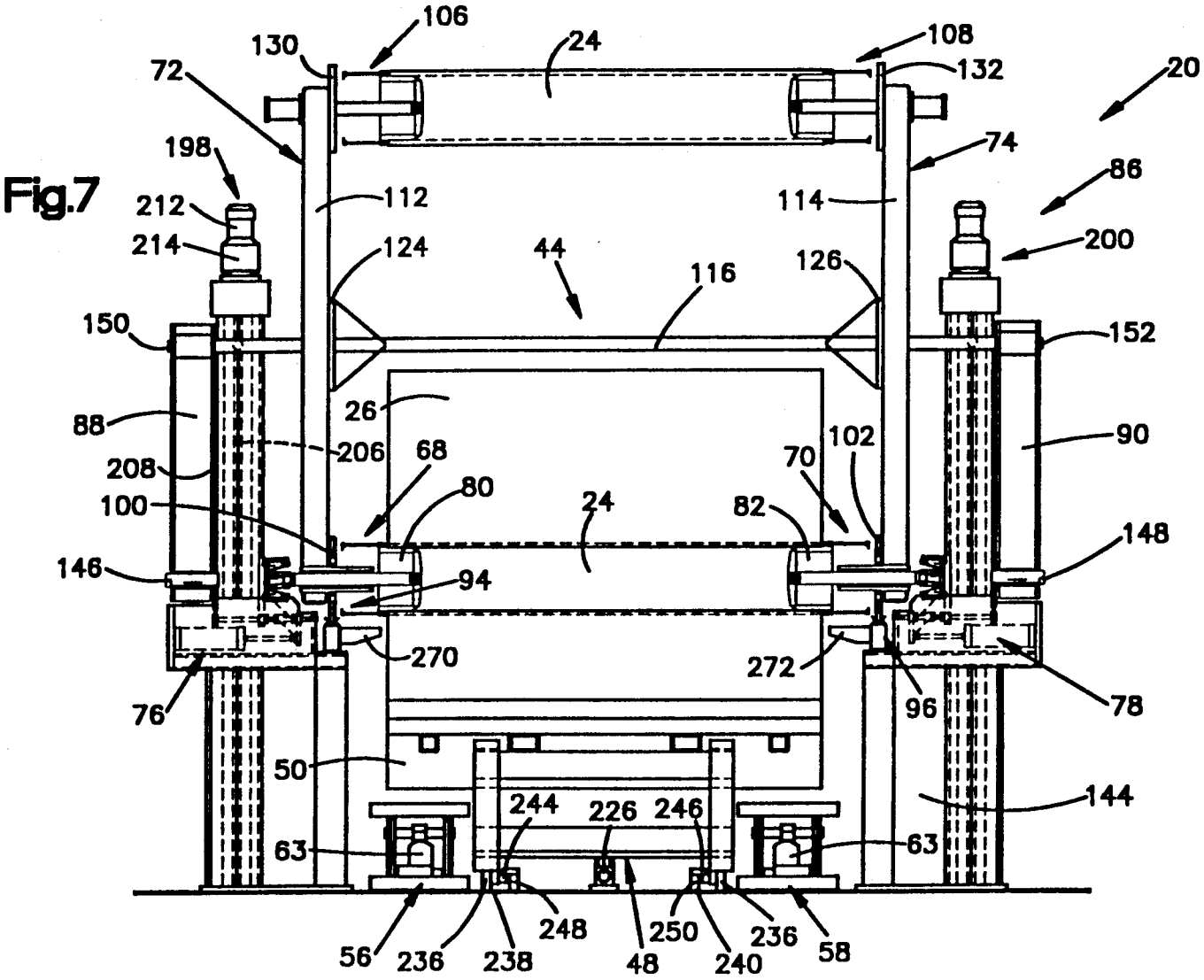
FIG. 7 is an elevational view, taken generally along the line 7—7 of FIG. 6, illustrating the relationship between the roll of material at the loading station, the transfer frame, and the empty roll core when the transfer frame is in the raised position.

The lift assemblies 56 and 58 move the storage roll 26, with the central axis 64 of the roll core 24 horizontal until the central axis 26 of the roll core is in alignment with a pair of identical spindle assemblies 68 and 70 (FIGS. 2 and 3) which form part of a frame assembly 72. The spindle assemblies 68 and 70 are disposed at one end of a generally H-shaped transfer frame 74 which also forms part of the frame assembly 72. A pair of identical spindle actuator assemblies 76 and 78 (FIGS. 3, 4 and 7) are operable to telescopically move generally cylindrical core plugs 80 and 82 into telescopic engagement with opposite ends of the hollow cylindrical core 24 of the storage roll 26 (FIG. 7). Once the spindle assemblies 68 and 70 have engaged the core 24 of the storage roll 26, the lift assemblies 56 and 58 are retracted to lower the cradle 50 (FIG. 2). The cradle 50 remains at the loading station 44 on the lowered lift assemblies 56 and 58.

After the toilet tissue has been unwound from a storage roll 26 (FIG. 2) at the unwinding station 34, the empty roll core 24 (not shown in FIG. 2) is held by the transfer frame 72. A transfer frame drive assembly 86 (FIGS. 2 and 3) is then operable to turn the frame assembly 72 end-for-end. This moves the empty roll core 24 from the unwinding station 34 to the loading station 44 and moves the next succeeding storage roll 26 from the loading station 44 to the unwinding station.

Figure 6:
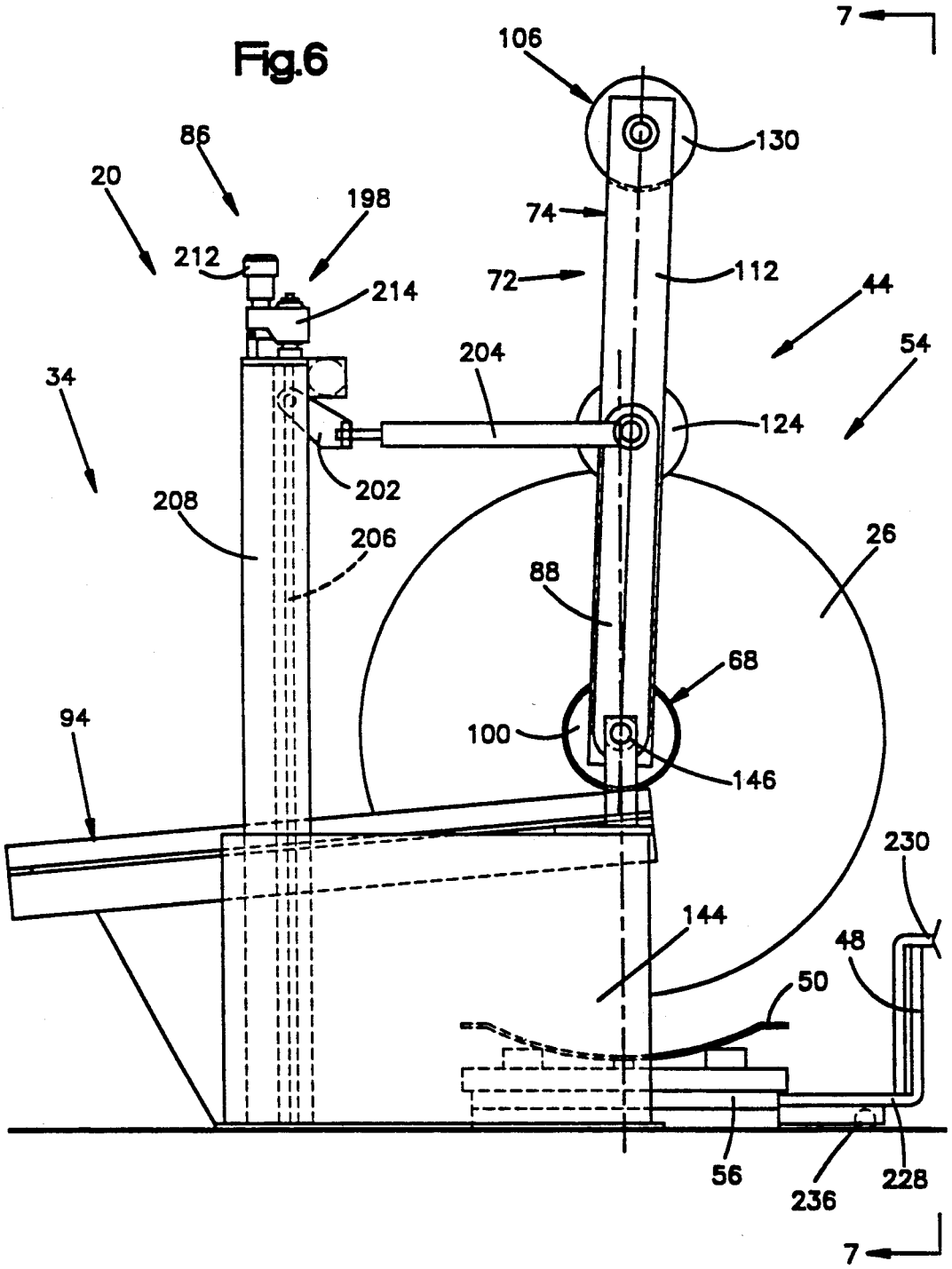
FIG. 6 is a side elevational view, generally similar to FIG. 2 but on a somewhat reduced scale, illustrating the relationship between a roll of material at the loading station and a transfer frame with the transfer frame in a raised position in which an empty core is disposed at an intermediate position directly above the loading station.

Initial operation of the drive assembly 86 pivots the frame assembly 72 from the lowered position of FIG. 2 to the raised position of FIGS. 6 and 7. As the assembly 72 moves from the lowered position to the raised position, a pair of parallel drive arms 88 and 90 (FIGS. 3 and 7) in the drive assembly 86 pivot the transfer frame 74 about the central axis 64 of the stationary core 24 of the storage roll 26 disposed at the loading station 44. As the transfer frame 74 pivots from the lowered position (FIG. 2) to the raised position (FIG. 6), the empty roll core 24 moves along an arcuate path from the unwinding station 34 to an intermediate location directly above the stationary storage roll at the loading station 44.

Figure 3:
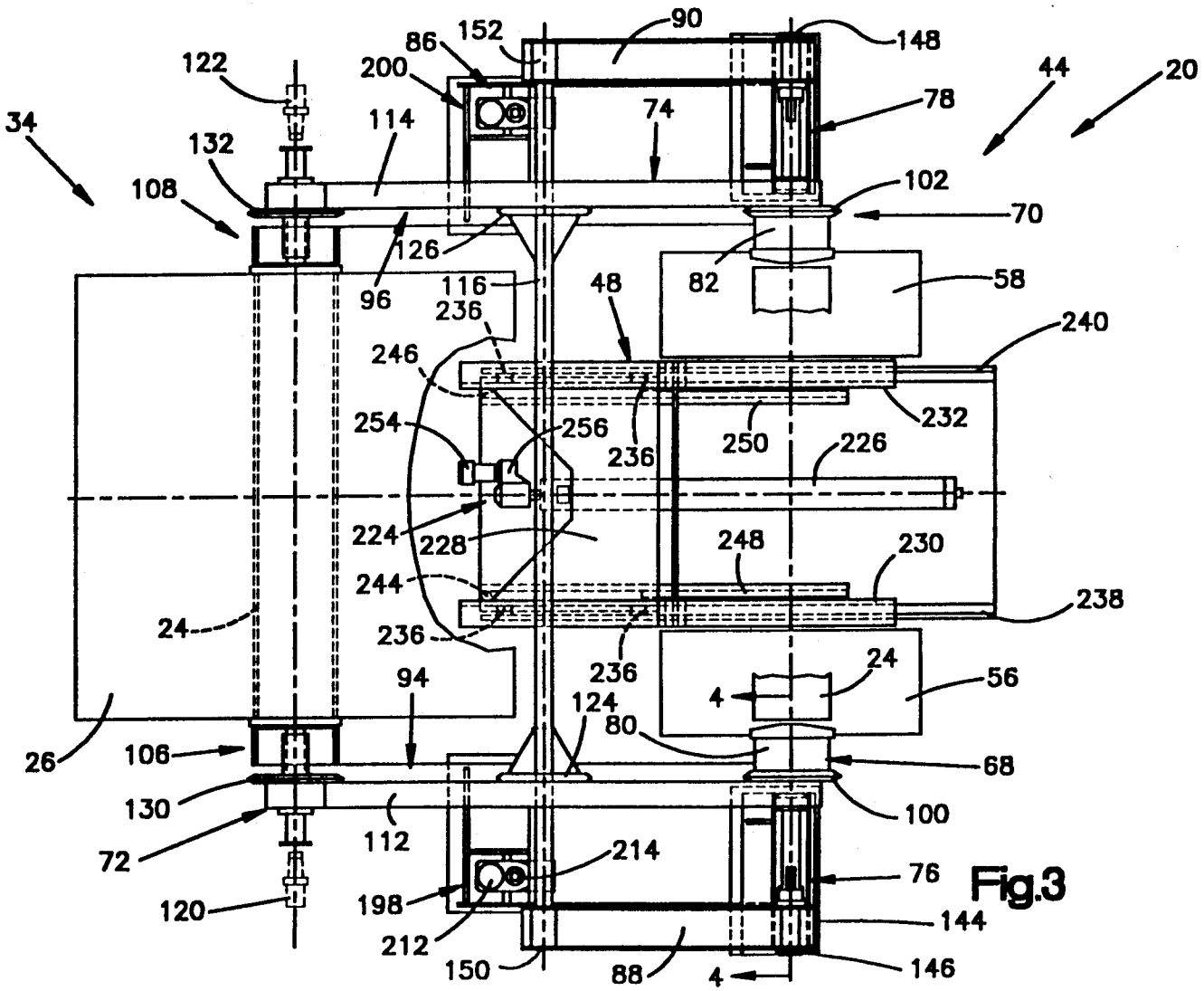
FIG. 3 is a plan view, taken generally along the line 3—3 of FIG. 1, illustrating the relationship between the material handling apparatus and an empty roll core at a loading station, a roll of material at an unwinding station, and a transfer car when the transfer car has been moved from the extended position shown in FIG. 1 to a retracted position beneath the loading station.

Continued operation of the drive assembly 86 results in movement of the storage roll 26 along a pair of parallel, linear rails 94 and 96 (FIGS. 3, 6 and 7) which extend between the loading station 44 and unwinding station 34 (FIGS. 3 and 6). As the roll 26 moves along the rails 94 and 96, support wheels 100 and 102 roll along the downwardly sloping rails under the influence of gravity. The weight of the storage roll 26 is supported on the rails 94 and 96 by the wheels 100 and 102. The storage roll 26 moves along a linear path from the loading station 44 through the transient position shown in FIG. 8 to the unwinding station 34.

Figure 8:
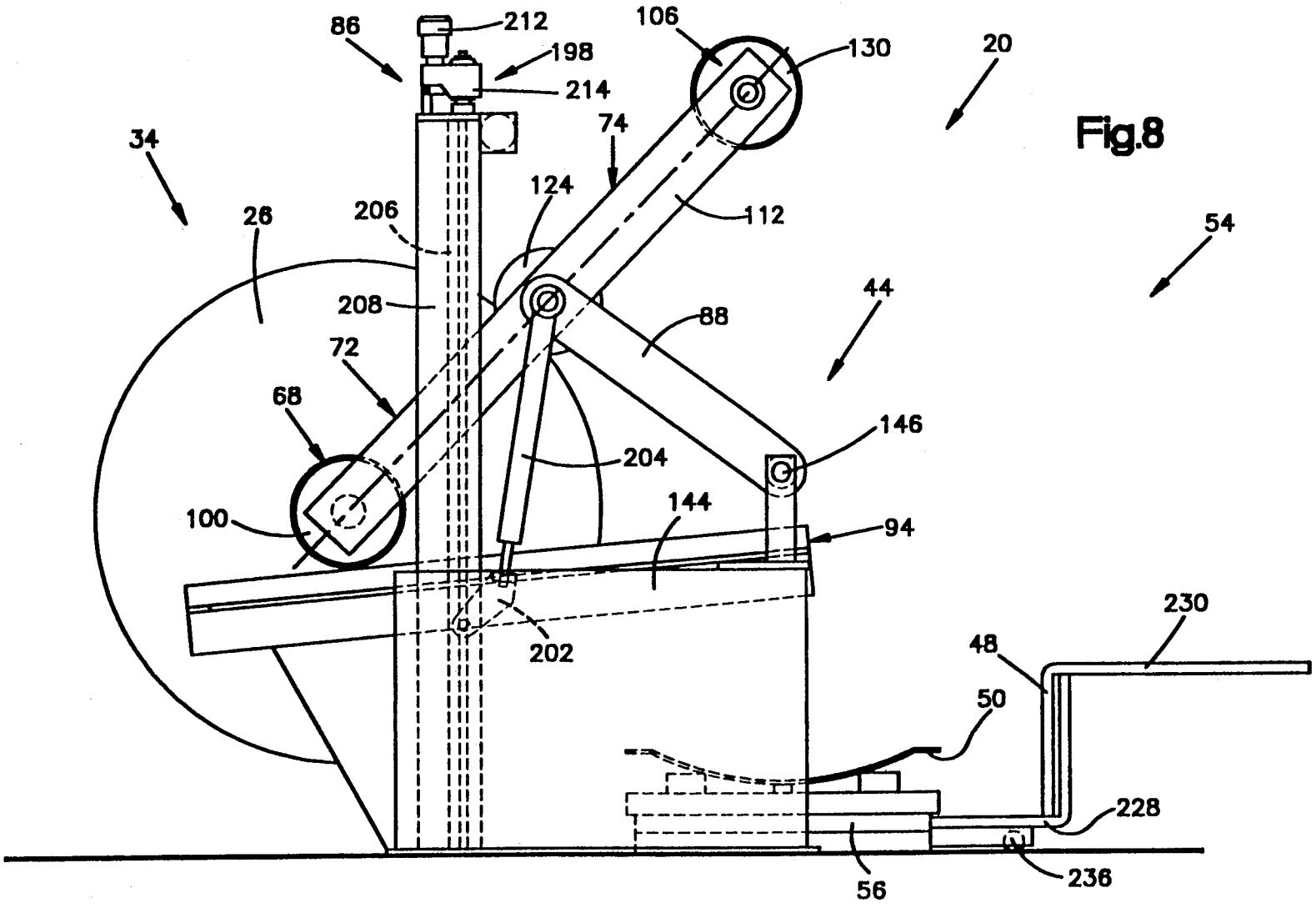
FIG. 8 is a side elevational view, generally similar to FIGS. 2 and 6, illustrating the relationship between a roll of material and the transfer frame in a transient condition when the transfer frame has been rotated to effect movement of the roll of material through a portion of the distance from the loading station to the unwinding station.

As the storage roll 26 moves along the rails 94 and 96 to the unwinding station 34, the empty core 24 is moved vertically downwardly, along a linear path, from an intermediate position above the loading station 44 (FIG. 6) through the transient position of FIG. 8 to the loading station. During this movement, the empty storage roll core 24 is held by identical spindle assemblies 106 and 108 (FIGS. 2, 3, 6 and 7). The spindle assemblies 106 and 108 form part of the frame assembly 72 and are disposed at an end of the H-shaped transfer frame 74 opposite from the spindle assemblies 68 and 70. The spindle assemblies 106 and 108 have the same construction as the spindle assemblies 68 and 70.

The length of the transfer frame 74 is the same as the distance between the loading station 44 and unwinding station 34. Therefore, the empty roll core 24 is supported by the frame assembly 72 at the loading station 44 while the storage roll 26 is supported by the frame assembly at the unwinding station 34. A roll core 24 is engaged by the same pair of spindle assemblies 68 and 70 or 106 and 108 from the time a storage roll 26 is moved from the loading station 44 until the empty roll core is returned to the loading station.

When the empty roll core 24 has been returned to the loading station 44, the lift assemblies 56 and 58 raise the cradle 50 (FIG. 7) to a position immediately beneath the empty core. The spindle actuator assemblies 76 and 78 ar then operated to actuate the spindle assemblies 106 and 108 to drop the empty roll core 24 onto the cradle 50. The transfer car 48 is moved from the pickup and delivery station 54 to a position beneath the cradle 50. The lift assemblies 56 and 58 then lower the cradle 50 onto the transfer car 48. The transfer car 48 moves the cradle 50, with the empty core 24 on the cradle, from the loading station 44 to the pick up and delivery station 54 where the cradle 50 is engaged by the vehicle 52 (FIG. 1).

A next succeeding storage roll 26 is then moved to the loading station 44 and engaged by the frame assembly 72. After the web 32 of tissue has been removed from the storage roll 26 at the unwinding station 34, the frame assembly 72 is again rotated end-for-end. This moves the empty core 24 from the unwinding station 34 to the loading station 44 and moves the next succeeding storage roll 26 from the loading station 44 to the unwinding station.

Although the material handling apparatus 20 is advantageously used with the relatively large storage rolls 26 of toilet tissue, it is contemplated that the material handling apparatus could be used to sequentially move rolls of many different kinds of materials from the loading station 44 to the unwinding station 34. Of course, the material removed from a roll at the unwinding station 34 would be conducted to an apparatus having a construction different than the construction of the rewind assembly 22. It is also contemplated that the material handling apparatus 20 will be particularly advantageous in the handling of rolls of material which have a noncylindrical configuration. However, the material handling apparatus 20 can be used to handle rolls of material having a cylindrical configuration.

Transfer Frame

The transfer frame 74 is turned end-for-end by the transfer frame drive assembly 86 to sequentially move storage rolls 26 from the loading station 44 to the unwinding station 34 and to sequentially move empty cores 24 from the unwinding station back to the loading station. The transfer frame 74 has a generally H-shaped configuration (FIGS. 3 and 7). Thus, the transfer frame 74 includes a pair of rigid parallel main arms 112 and 114. The main arms 112 and 114 are pivotally mounted on and interconnected by a cross arm 116. The cross arm 116 extends perpendicular to the main arms 112 and 114 of the transfer frame 74.

The main arms 112 and 114 of the transfer frame 74 are sized so as to extend from the loading station 44 to the winding station 34 when the transfer frame 74 is in the lowered position of FIGS. 2 and 3. Thus, when the transfer frame 74 is in the lowered position, the spindle assemblies 68, 70, 106 and 108 (FIG. 3) at opposite ends of the transfer frame are disposed at the loading station 44 and unwinding station 34. The transfer frame 74 is pivoted around the pair of spindle assemblies 68 and 70 or 106 and 108 which are connected with a storage roll 26 during movement of the transfer frame 74 from the lowered position of FIG. 2 to the raised position of FIG. 6 and during movement of the transfer frame from the raised position of FIG. 6 through the transient position of FIG. 8 and back to the lowered position of FIG. 2. However, the transfer frame 74 also pivots about the cross member 116 during movement of the transfer frame between the raised and lowered positions.

During the unwinding of toilet tissue from a storage roll 26 at the unwinding station 34, live centers 120 and 122 (shown in dash-dot-dot lines in FIG. 3) engage the spindle assemblies 106 and 108 to support the weight of the storage roll 26. The live centers 120 and 122 are part of the rewind assembly 22 (FIG. 1). In order to prevent the transfer of force to the rewind assembly 22 from the material handling apparatus 20, the weight of the frame assembly 72 is supported by a pair of fulcrum wheels 124 and 126 (FIGS. 2, 3 and 7) when the transfer frame 74 is in the lowered position of FIG. 2.

The fulcrum wheels 124 and 126 are mounted on the cross member 116 (FIGS. 3 and 7). The fulcrum wheels 124 and 126 have a diameter which is just slightly greater than the diameter of the support wheels 100 and 102 in the spindle assemblies 68 and 70 and support wheels 130 and 132 (FIGS. 3 and 7) in the spindle assemblies 106 and 108. Therefore, when the transfer frame 74 is in the lowered position of FIG. 2 with the main arms 112 and 114 (FIG. 3) extending parallel to the rails 94 and 96, the wheels 100, 102, 130 and 132 in the spindle assemblies 68, 70, 106 and 108 are raised slightly off of the rails 94 and 96. At this time, the fulcrum wheels 124 and 126 engage the rails 94 and 96 and support the transfer frame 74. Therefore, the weight of the frame assembly 72 does not have to be carried by the live centers 120 and 122 (FIG. 3) of the rewind assembly 22 (FIG. 1).

It is contemplated that the size of the transfer frame 74 will vary depending upon the dimension of the rolls of material to be handled. In one specific embodiment of the transfer frame 74, the distance between the coaxial central axes of the spindle assemblies 68 and 70 at one end of the main arms 112 and 114 and the coaxial central axes of the spindle assemblies 106 and 108 at the opposite end of the main arms was approximately 2,891 mm. In this particular embodiment of the material handling apparatus 20, the distance between the tracks 94 and 96 and the wheels 100 and 102 was 3,350 mm. It should be understood that the foregoing specific dimensions have been set forth only for purposes of clarity of description and it is contemplated that the transfer frame 74 may be constructed with many different dimensions depending upon the size of the rolls of material with which the material handling apparatus 20 is used.

Spindle Assemblies

The identical spindle assemblies 68, 70, 106 and 108 connect the ends of the storage roll cores 24 with the ends of the main arms 112 and 114 of the transfer frame 74. In addition, the spindle assemblies 68, 70, 106 and 108 include storage roll support wheels 100, 102, 130 and 132. The support wheels 1090, 102, 130 and 132 roll along the linear rails 94 and 96 and carry the weight of the storage rolls 26 during movement of the storage rolls from the loading station 44 to the unwinding station 34.

The spindle assemblies 68 and 70 engage opposite ends of a storage roll core 24 to form an axle to support a storage roll 26 from wheels 100 and 102. Similarly, the spindle assemblies 106 and 108 engage opposite ends of a storage roll core 24 to form an axle to support a storage roll from the wheels 130 and 132. During movement of a storage roll 26 along the parallel rails 94 and 96, the storage roll is suspended between the rails on an axle which extends between ends of the main arms 112 and 114 of the transfer frame 74. The axle is formed by engagement of spindle assemblies 68 and 70 or 106 and 108 (FIG. 7) with a roll core 24.

The spindle assembly 68 (FIG. 4) includes a generally cylindrical core plug 80 which is fixedly connected to one end of a cylindrical spindle shaft 130. The spindle shaft 30 is rotatably and slidably supported by linear rotary bearings 132 and 134 disposed between the outer side surface of the spindle shaft and a cylindrical axle housing 136. The bearings 132 and 134 enable relative rotation to occur between the axle housing 136 and the spindle shaft 130. Therefore, the transfer frame 74 can be pivoted relative to the spindle shaft 130 without rotating the spindle shaft about its central axis. The bearings 132 and 134 also support the spindle shaft 130 for axial movement relative to the axle housing 136.

The circular wheel 100 is rotatably mounted on the axle housing 136 by bearings 140. The wheel 100 engages an upwardly opening V-track 142 which forms part of the rail 94. The linear V-track 142 engages the wheel 100 to support one end portion of the storage roll 26 and to guide movement of the wheel 100 along the rail 94 from the loading station 44 to the unwinding station 34. The rail 94 is supported on a base frame 144 of the material handling apparatus 20.

Figure 4:
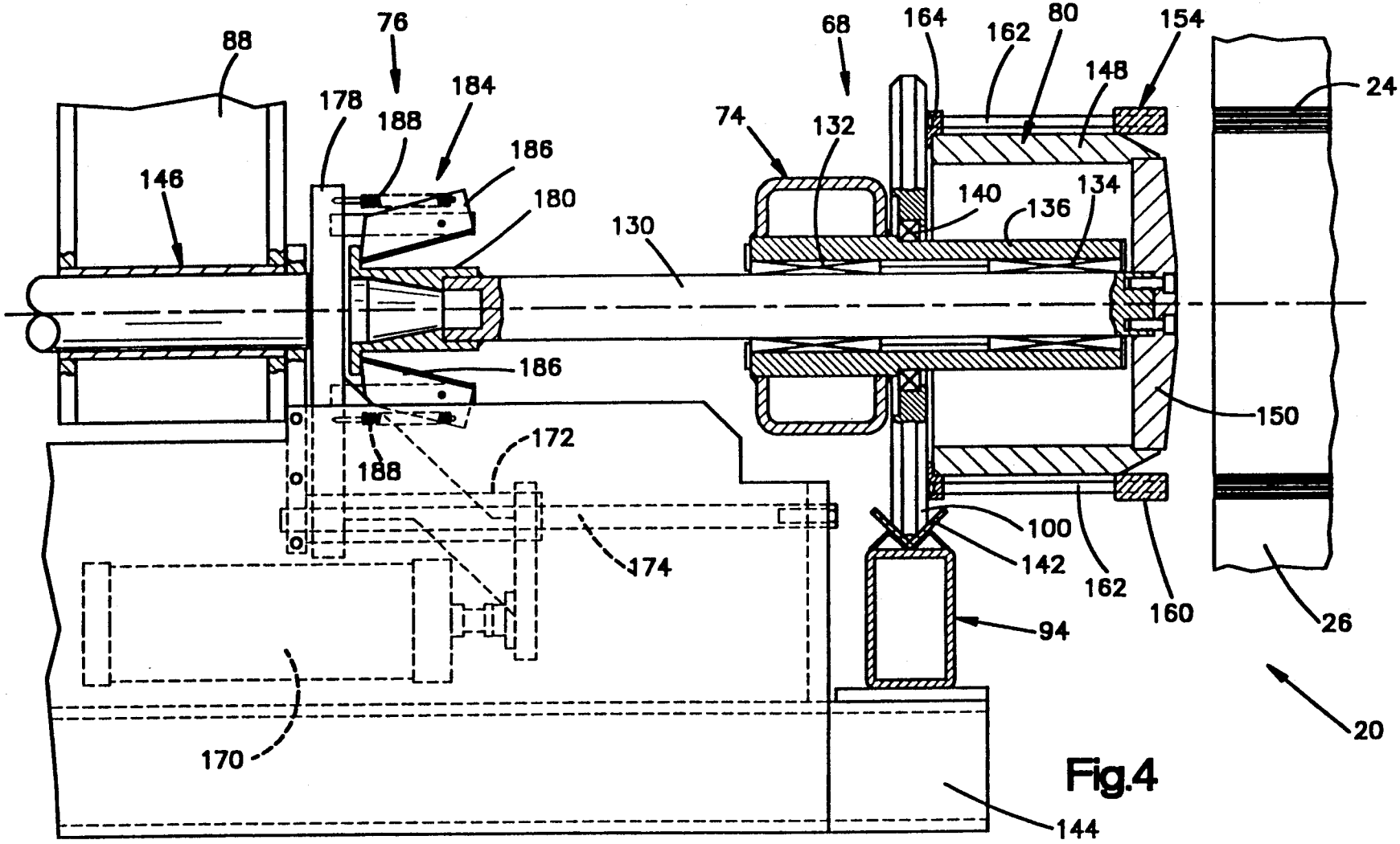
FIG. 4 is a fragmentary elevational sectional view, on an enlarged scale and taken generally along the line 4—4 of FIG. 3, illustrating the relationship between a core plug and an empty roll core, the core plug being shown disengaged from the roll core.
Figure 5:
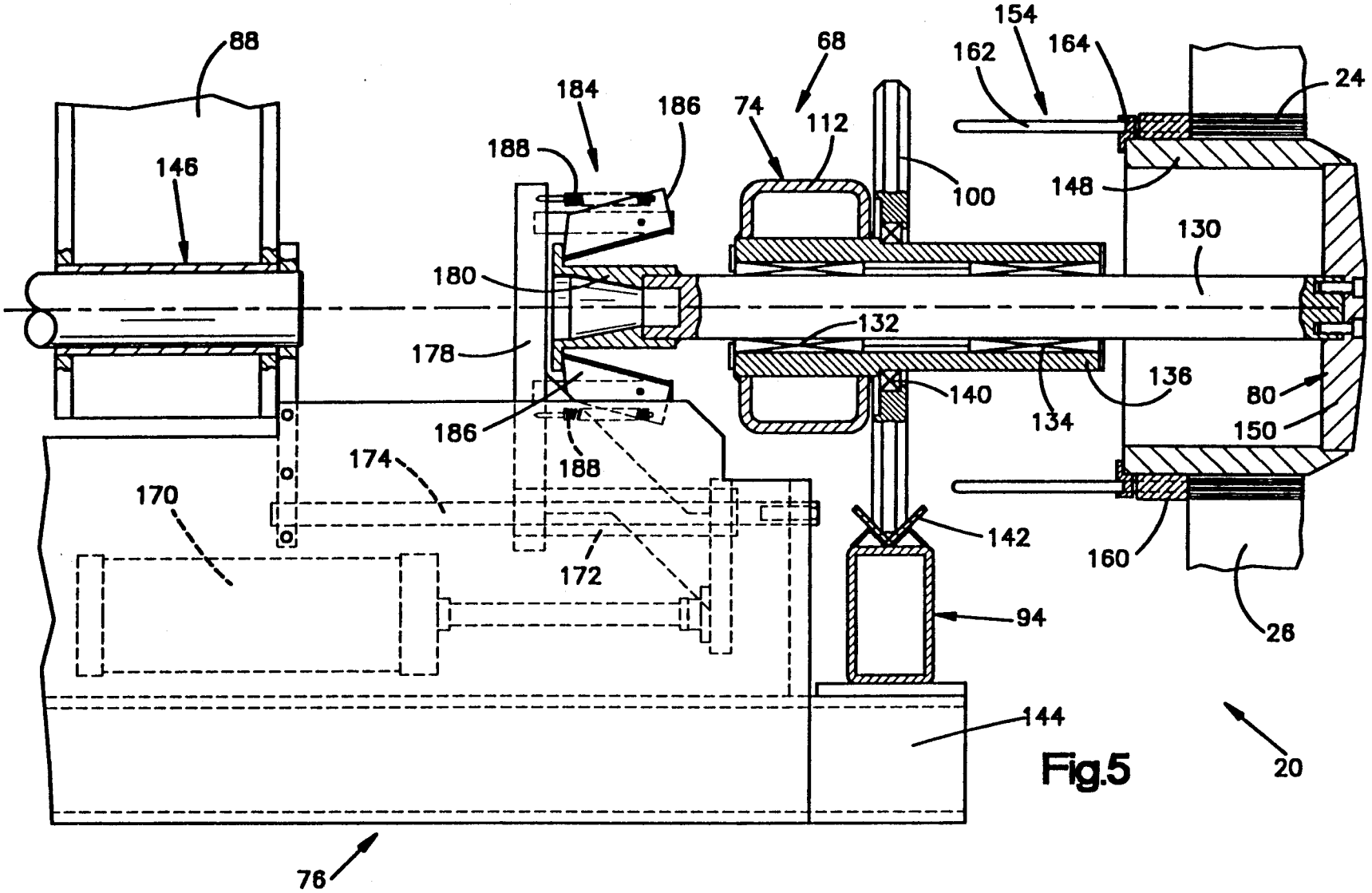
FIG. 5 is a fragmentary elevational sectional view, generally similar to FIG. 4, illustrating the relationship between the roll core and the core plug when the core plug is in engagement with the roll core.

The core plug 80 is fixedly connected to the outer end portion of the spindle shaft 130 and includes a cylindrical side wall 148 which is telescopically inserted into the core 24 by movement of the spindle shaft 130 from the retracted position of FIG. 4 to the extended position of FIG. 5. The side wall 148 of the core plug 80 is supported by a circular end wall 150. During movement of a storage roll 26 along the linear rail 94 from the loading station 44 to the unwinding station 34, the wheel 100 rotates relative to the axle housing 136. However, the spindle shaft 130 and core plug 80 do not rotate. Therefore, the storage roll 26 does not rotate as it moves along the rail 94 from the loading station 44 to the unwinding station 34.

A stripper assembly 154 is mounted on the core plug 80 to be certain that the empty storage roll core 24 is disengaged from the core plug at the loading station 44. The stripper assembly 154 includes an annular stripper ring 160 which is mounted on the outer end portions of a plurality of stripper pins 162. The stripper pins 162 extend through an annular guide ring 164 disposed at the inner end portion of the core plug 80.

As the core plug 80 is moved from the extended position of FIG. 5 to the retracted position of FIG. 4, the stripper pins 162 engage the wheel 100. Therefore, as the core plug 80 continues to be retracted, the stripper ring 160 remains stationary. The core plug 80 moves from a position in which the stripper ring 160 is adjacent to the base of the core plug (FIG. 5) to a position in which the stripper ring is adjacent to the outer end of the core plug (FIG. 4). Therefore, the core 24 is pushed off of the core plug 80 if the core tends to remain on the core plug.

The spindle actuator assembly 76 is operable to move the spindle shaft 130 and core plug 80 between the retracted position of FIG. 4 and the extended position of FIG. 5. The spindle actuator assembly 76 includes a piston and cylinder type motor 170 which is operable to move a hollow cylindrical sleeve 172 along a horizontal support rod 174. As the sleeve 172 moves from the retracted position shown in FIG. 4 rightwardly toward the extended position shown in FIG. 5 upon operation of the motor 170, an arm 178 connected to the sleeve 172 pushes against a head end portion 180 of the spindle shaft 130. This results in the spindle shaft 130 and core plug 80 being moved from the retracted position of FIG. 4 to the extended position of FIG. 5. As the core plug 80 moves from the retracted position of FIG. 4 to the extended position of FIG. 5, it is telescopically inserted into the core 24 of a storage roll 26.

When the core plug 80 is to be disengaged from theempty core 24 of a storage roll 26, the operation of the motor 170 is reversed to move the sleeve 172 leftwardly along the support rod 174 from the position shown in FIG. 5 to the position shown in FIG. 4. As the sleeve 172 moves leftwardly along the support rod 174, a gripper assembly 184 connected with the arm 178 pulls the head end portion 180 of the spindle shaft 130 and core plug 80 leftwardly. As the core plug 80 moves leftwardly, the stripper pins 162 move into engagement with the wheel 100 and move the stripper ring 160 from the retracted position shown in FIGS. 5 to the extended position shown in FIG. 4 to be certain that the core 24 is disengaged from the core plug 80.

The gripper assembly 184 grips the head end portion 180 of the spindle shaft 130 to pull the spindle shaft axially from the extended position of FIG. 5 to the retracted position of FIG. 4. The gripper assembly 184 includes a plurality of gripper elements 186 which are pivotally mounted on the arm 178. The gripper elements 186 are urged inwardly toward the central axis of the spindle shaft 130 by biasing springs 188. Biasing springs 188 enable the gripper elements 186 to be cammed sidewardly as the arm 178 is moved toward the head end portion 180 of the spindle shaft 130. This enables the gripper elements to be deflected by the head end portion 180 of the spindle shaft and then to move inwardly into engagement with the head end portion of the spindle shaft.

Although only the spindle assembly 68 is shown in FIGS. 4 and 5, it should be understood that the spindle assemblies 70, 106 and 108 have the same construction and mode of operation as the spindle assembly 68. The spindle actuator assembly 78 (FIGS. 3 and 7) is mounted on a side of the base frame 144 opposite from the spindle actuator assembly 76 The spindle actuator assembly 78 has the same construction and mode of operation as the spindle actuator assembly 76.

Transfer Frame Drive Assembly

The transfer frame drive assembly 86 (FIGS. 2 and 3) is operable to repeatedly turn the transfer frame 74 end-for-end to sequentially move storage rolls 26 from the loading station 44 to the unwinding station 34 and to sequentially move empty storage roll cores 24 from the unwinding station back to the loading station. The transfer frame drive assembly 86 includes the parallel drive arms 88 and 90 (FIG. 3). The drive arms 88 and 90 are pivotally connected to the base frame 144 at pivot connections 146 and 148 (FIGS. 3 and 4). The opposite ends of the drive arms 88 and 90 are pivotally connected to the cross member 116 (FIG. 3) of the transfer frame 74 at pivot connections 150 and 152.

Although the transfer frame 74 is rotated end-for-end during operation of the transfer frame drive assembly 86, the drive arms 88 are only pivoted through an angle of approximately 97° between the lowered position shown in FIGS. 2 and 3 to the raised position shown in FIGS. 6 and 7. When the drive arms 88 and 90 are in the lowered position of FIGS. 2 and 3, the drive arms extend parallel to the rails 94 and 96 and to the main arms 112 and 114 of the transfer frame 74. At this time, the longitudinal central axes of the rails 94 and 96, the main arms 112 and 114 of the transfer frame 74, and drive arms 88 and 90 of the transfer frame drive assembly 86 are all parallel to each other and extend downwardly from the loading station 44 toward the unwinding station 34 at an angle of approximately 5° to a horizontal plane (FIG. 2).

When the transfer drive assembly 86 has moved the drive arms 88 and 90 and main arms 112 and 114 of the transfer frame 74 to the raised position of FIGS. 6 and 7, parallel longitudinal axes of the drive arms 88 and 90 and main frame arms 112 and 114 are offset in a clockwise direction (as viewed in FIG. 6) from a vertical plane through the pivot connections 146 and 148 by an angle of 2°. Therefore, when the transfer frame 74 and the drive arms 88 and 90 are in the raised position of FIGS. 6 and 7, the weight of the roll core 24 at the upper end of the transfer frame 74 and the weight of the transfer frame act to apply a clockwise (as viewed in FIG. 6) torque to the transfer frame 74. This clockwise torque promotes movement of the lower end portion of the transfer frame 74 and the storage roll 26 along the downwardly sloping rails 94 and 96 toward the unwinding station 34.

To pivot the drive arms 88 and 90 between the lowered position of FIGS. 2 and 3 and the raised position of FIGS. 6 and 7, the drive assembly 86 includes a pair of identical drive mechanisms 198 and 200 (FIGS. 3 and 7) which are connected with the drive arms 88 and 90. The drive mechanisms 198 and 200 are connected with the base frame 144 on opposite sides of the main frame 74 adjacent to the free ends of the drive arms 88 and 90 (FIGS. 3 and 7).

The drive mechanism 198 includes a carriage 202 (FIGS. 2 and 6) which is connected with the drive arm 88 by a drive bar or link 204. The carriage 202 is movable along a vertical drive screw 206 disposed in a vertically extending tower or housing 208. A reversible electric motor 212 is connected with the upper end of the drive screw 206 through a speed reducer and brake assembly 214.

When the drive arm 88 is in the lowered position of FIG. 2, the drive link 204 extends generally vertically upwardly from the carriage 202 to a pivot connection with the outer end of the drive arm 88. When the carriage 162 is at the upper end of the drive screw 206 (FIG. 6) and the drive arm 88 is in the raised position, the drive link 204 extends generally horizontally between the carriage and the free end of the drive arm 88. As the carriage 202 moves upwardly from the lowered position of FIG. 2 to the raised position of FIG. 6, the heavy storage roll 26 remains stationary at the loading station 44. As this occurs, the empty core 24 is moved along an arcuate path extending from the unwinding station 34 to the intermediate location directly above the storage roll 26 at the loading station. 44 (FIG. 6).

The drive arms 88 and 90 pivot about their connections 146 and 148 with the base frame 144. At this time, the central axes of the spindle assemblies 68 and 70 are coincident with the central axes of the pivot connections 146 and 148. Therefore, the transfer frame 74 and drive arms 88 and 90 pivot about the spindle assemblies 68 and 70 (FIG. 3) connected with opposite ends of the stationary storage roll 26.

When the direction of operation of the motor 212 is reversed with the transfer frame 74 in the raised position of FIG. 6, the carriage 202 moves down the drive screw 206. As the carriage 202 moves down the drive screw 206, wheel 100 starts to roll down the rail 94 to begin movement of the storage roll 26 from the loading station 44 toward theunwinding station 34. Movement of the wheel 100 and storage roll 26 along the rail 94 is initiated during downward movement of the carriage 202 due to the downward inclination of the rail 94 and the clockwise torque applied to the transfer frame 94 by the empty core 24 and weight of the frame 74 when the frame is in the raised position of FIG. 6.

In the illustrated embodiment of the invention, the rail 94 slopes downwardly at an angle of 5°. The transfer frame 74 is held in a generally vertical position with its longitudinal axis 2° past a vertical plane when the transfer frame is in the raised position of FIG. 6. Of course, the rail 94 could slope downwardly at a different angle and the transfer frame 74 could be at a different angle relative to a vertical plane if desired.

As the carriage 202 moves down the vertical screw 206, the drive link 204 controls pivotal movement of the transfer frame 74 from the raised orientation of FIG. 6 through the partially lowered orientation of FIG. 8 to the lowered position of FIG. 2. As this occurs, the wheel 100 rolls along the rail 94. As the wheel 100 rolls along the linear rail 94 and the storage roll 26 moves from the loading station 44 toward the unwinding station 34, the heavy storage roll does not rotate. The wheel 100 merely rotates on the axle housing 136 (FIGS. 4 and 5)

As the storage roll 26 is moving along the rail 94 toward the unwinding station 34, the empty core 24 moves downwardly along a linear and generally vertical path from the intermediate position above the loading station 44 to the loading station. Thus, the empty core 24 is first moved along an arcuate path from the unwinding station 34 to a position above the loading station 44 while the storage roll 26 remains stationary at the loading station. The empty core 24 then moves straight downwardly along a linear path from a location above the loading station 44 to the loading station as the storage roll 26 moves along a linear and downwardly inclined path from the loading station 44 to the unwinding station 34.

Although only the drive mechanism 198 for the left (as viewed in FIG. 7) drive arm 88 was previously described, it should be understood that the drive mechanism 200 cooperates with the drive arm 90 in the same manner as in which the drive mechanism 198 cooperates with the drive arm 88. The two drive mechanisms 198 and 200 are connected with the transfer frame cross member 116 and operate in unison to pivot the transfer frame 74 and drive arms 88 and 90 together. Therefore, the wheels 100 and 102 (FIG. 7) both roll along the rails 94 and 96 as the storage roll 26 moves from the loading station to the unwinding station. Although the drive mechanisms 198 and 200 both have vertical drive screws which ar connected with the drive arms 88 and 90 through drive links corresponding to the drive link 204, it is contemplated that a different type of drive mechanism could be connected with the drive arms 88 and 90 in a different manner. For example, the drive mechanisms 158 and 160 could have piston and cylinder assemblies connected with the outer ends of the drive arms 88 and 90 and with a lower portion of the main frame 144 to pivot the drive arms 88 and 90 and transfer frame 74 relative to the main frame 144.

Operation

When approximately 60% of the toilet tissue has been unwound from the storage roll 26 at the unwinding station 34 (FIG. 1), an operator signals the controls for the automatic guided vehicle 52 to initiate the positioning of a next succeeding storage roll 26 at the loading station 44. At this time, the transfer car 48 will be at the pickup and delivery station 54. The transfer frame 74 will be oriented with the spindle assemblies 68 and 70 at the loading station 44. The spindle assemblies 68 and 70 will have been disengaged from the empty core 24 which they previously moved to the loading station 44 and the empty core will have been removed by the vehicle 52. Therefore, the material handling apparatus 20 is ready to receive a next succeeding storage roll 26 while the web 32 continues to be unwound from the storage roll at the unwinding station 34.

The vehicle 52 picks up the next storage roll 26 on a cradle 50 at a pick up station (not shown) and moves the next storage roll 26 to the material handling apparatus 20. As the vehicle 52 approaches the material handling apparatus 20, the vehicle will be moving perpendicular to the horizontal axes of the spindle assemblies 68 and 70. At this time, the central axis of the core 24 of the storage roll being carried by the vehicle 52 will extend parallel to the path of travel of the vehicle. Thus, the central axis of the core 24 of the storage roll being carried by the vehicle 52 will extend perpendicular to the axes of the spindle assemblies 68 and 70 as the vehicle 52 approaches the pickup and delivery station 54.

Once the vehicle 52 has reached the pickup and delivery station 54 (FIG. 1), the vehicle is stopped. A turntable 222 on the vehicle 52 is then rotated about a vertical axis. This moves the storage roll 26 to the position illustrated in FIG. 1 with the central axis of the core 24 extending parallel to the central axes of the spindle assemblies 68 and 70.

The turntable 222 is then lowered. This deposits the cradle 50 and storage roll 26 on the transfer car 48. At this time, the central axis of the core 24 of the storage roll 26 is disposed above the central axes of the spindle assemblies 68 and 70 (FIG. 1).

A transfer car drive assembly 224 (FIG. 3) is then operated to move the storage roll 26 from the pickup and delivery station 54 to the loading station 44. The transfer car drive assembly 224 includes a transfer car drive screw 226 which is fixedly mounted to a floor on which the material handling apparatus 20 is supported (FIGS. 3 and 7). The transfer car 48 has a lower support section 228 which extends rearwardly from a pair of raised load engaging forks 230 and 232 (FIGS. 2 and 3).

The rearwardly extending support section 228 has a plurality of rollers 236 (FIG. 3) which roll along parallel linear tracks 238 and 240 on the floor (FIGS. 3 and 7). A plurality of retainer wheels 244 and 246 (FIGS. 3 and 7) engage linear floor mounted retainer rails 248 and 250 which extend over the upper side of the retainer wheels. The retainer rails 248 and 250 cooperate with the retainer wheels 244 and 246 to hold the rear or left end portion (as viewed in FIG. 3) of the transfer car 48 from tipping up under the influence of a load on the forks 230 and 232.

The transfer car 48 is moved along the tracks 238 and 240 by operation of a reversible electric motor 254 (FIGS. 3) connected to the rearward end of the drive screw 226 through a speed reducer and brake assembly 256. Thus, when the cradle 50 and storage roll 26 (FIG. 1) have been transferred from the vehicle 52 to the transfer car 48 (FIG. 1), the motor 254 is operated to rotate the drive screw 226. This moves the transfer car 48 rearwardly from the position shown in FIG. 1 to the position shown in FIGS. 3. As the transfer car 48 moves rearwardly, the storage roll 26 is moved between the spindle assemblies 68 and 70 connected with the right (as viewed in FIG. 3) end portion of the transfer frame 74.

The scissor-type lift assemblies 56 and 58 are then raised to lift the cradle 50 upwardly off of the transfer car 48. The transfer car drive assembly 224 is then operated to move the transfer car 48 forwardly from the loading station 44 back to the pickup and delivery station 54 (FIG. 2). As the transfer car 48 moves forwardly, the cradle 50 and storage roll 26 are supported in a stationary relationship relative to the loading station 44 on the lift assemblies 56 and 58. At this time, the core 24 of the storage roll 26 is above the spindle assemblies 68 and 70.

The lift control assembly 62 (FIG. 9) is then operated to orient the storage roll 26 with the central axis 64 of its core 24 horizontal. In all probability, the storage roll 26 will not initially be supported on the cradle 50 with the central axis 64 of its core 24 horizontal. This is because the storage roll 26 probably has a noncylindrical shape due to the uneven layering of the toilet tissue on the core 24 as the storage roll is formed and due to settling or sagging of the material on the storage roll with the passage of time after formation of the storage roll 26.

To position the storage roll 26 with the central axis 64 of the core 24 horizontal, a controller 262 actuates the valve assemblies 264 and 266 (FIG. 9) to effect operation of the lift assemblies 56 and 58 to lower the storage roll 26 at the loading station 44. Lowering of the storage roll 26 continues until the core 24 is below the coincident central axes of the spindle assemblies 68 and 70. The lowering of the storage roll 26 is not stopped until the core 24 is aligned with a pair of photoelectric sensors 270 and 272 (FIGS. 7 and 9) disposed on opposite sides of the loading station 44.

When the lift assemblies 56 and 58 have lowered the storage roll 26 to a level at which the photosensors 270 and 272 are both certain to be aligned with the open central portion of the core 24 of the storage roll 26, the controller 262 actuates the valve assemblies 264 and 266 (FIG. 9) to stop the downward lowering or retracting operation of the lift assemblies 56 and 58. The controller 262 then effects operation of both lift assemblies 56 and 58 to raise the storage roll 26 until one of the photoelectric sensors 270 and 272 detects an inside corner at an end of the storage roll core 24. The operation of the lift assembly 56 or 58 associated with that sensor is then stopped. The other lift assembly 56 or 58 is then operated until the photoelectric sensor associated with that lift assembly detects the opposite inside corner at the end of the storage roll core 24. The operation of the second lift assembly is then stopped.

For example, if the storage roll 26 had a noncylindrical configuration which resulted in the left (as viewed in FIG. 9) end of the core 24 being higher than the right end of the core, the controller 262 would effect operation of both of the lift assemblies 56 and 58 to raise the storage roll 26 until the left (as viewed in FIG. 9) photoelectric sensor 270 detected the relatively high inside lower corner 274 of the core 24. As soon as the corner 274 of the core 24 is sensed by the sensor assembly 270, the controller 262 actuates the valve assembly 264 to stop operation of the lift assembly 56. However, the lift assembly 58 keeps operating to raise the relatively low right side of the storage roll core 24. As soon as the photoelectric sensor 272 detects the lower inside corner 276 of the core 24, the controller 262 stops operation of the lift assembly 58.

Since the photoelectric sensor assemblies 270 and 272 are disposed at the same level, when the corners 274 and 276 are detected by the sensor assemblies 270 and 272, the central axis 64 of the core 24 is horizontal. Once the storage roll 26 has been positioned with the central axis 64 of the core 24 horizontal, the controller 262 actuates the valve assemblies 264 and 266 to effect simultaneous operation of the lift assemblies 56 and 58. The lift assemblies 56 and 58 raise the storage roll 26 until the horizontal central axis 64 of the core 24 is coincident with the central axes of the spindle assemblies 68 and 70.

Although the photoelectric sensors 270 and 272 could have many different constructions, in one embodiment of the invention, the photoelectric sensor 270 included a light emitting diode 280 and a photocell 282. Similarly, the photoelectric sensor 272 includes a light emitting diode 284 and a photocell 286. The range of the light emitting diodes 280 and 284 is substantially less than the axial extent of the core 24. Therefore, the photocells 282 and 286 are activated only by light reflected from the lower inside corners 274 and 276 of the core 24 as the storage roll 26 is moved upwardly. When the storage roll 26 has been aligned with the spindle assemblies 68 and 70 with the core 24 of the storage roll horizontal, the spindle actuator assemblies 76 and 78 (FIG. 7) are operated to simultaneously move the core plugs 80 and 82 into engagement with core 24 of the storage roll. Thus, the motor 170 of the spindle actuator assembly 76 is operated to move the core plug 80 of the spindle assembly 68 from the retracted position shown in FIG. 4 to the extended position shown in FIG. 5. The spindle actuator assembly 78 (FIG. 7) is operated at the same time to move the core plug 82 into the opposite end of the core 24. As this occurs, the stripper rings on the core plugs 80 and 82, corresponding to the stripper ring 160 for the core plug 80, move from the extended position of FIG. 4 to the retracted position of FIG. 5. Although the core plugs 80 and 82 have been inserted into opposite ends of the core 24 of the storage roll 26 at the loading station 44, the storage roll continues to be supported by the cradle 50 on the lift assemblies 56 and 58. If the lift assemblies 56 and 58 were lowered at this time, there would be a slight pivoting movement of the transfer frame 74 about the fulcrum wheels 124 and 126. Although this slight pivoting movement could be accommodated by the live centers 120 and 122 (FIG. 3), it is preferred to maintain the transfer frame 74 stationary, with the weight of the frame carried by the fulcrum wheels 124 and 126, until completion of the unwinding of the toilet tissue from the storage roll 26 at the unwinding station 34. In order to avoid any possible interference between the rewind assembly 22 (FIG. 1) and the material handling apparatus 20, engagement of the spindle assemblies 68 and 70 with the core 24 of the storage roll 26 at the loading station 44 could be delayed until after the live centers 120 and 122 (FIG. 3) have separated from the spindle assemblies 106 and 108.

Once the unwinding of the toilet tissue from the storage roll 26 at the unwinding station 34 has been completed, only the empty core 24 remains. At this time, the live centers 120 and 122 are withdrawn from engagement with the spindle assemblies 106 and 108. The controller 62 (FIG. 9) then actuates the control valves 264 and 266 to effect operation of the lift assemblies 56 and 58 to lower the cradle 50. Thus, the cradle 50 moves downwardly away from the storage roll 26 to the position shown in FIG. 2. At this time, the transfer car 48 is at the pickup and delivery station 54 and is out of the way of the downward movement of the cradle 50.

As the cradle 50 is disengaged from the storage roll 26, the weight of the storage roll is transmitted by support wheels 100 and 102 (FIG. 3) to the rails 94 and 96. As this occurs, there is a slight pivoting movement of the transfer frame 74 about the fulcrum wheels 124 and 126. Thus, the end of the transfer frame 74 at the loading station 44 moves slightly downwardly while the end of the transfer frame at the unwinding station 34 moves slightly upwardly. At this time, the spindle assemblies 68 and 70 engage the core 24 of the storage roll 26 to form an axle assembly. The weight of the storage roll 26 is transmitted through the wheels 100 and 102, at opposite ends of the storage roll 26, to the rails 94 and 96.

Once the weight of the storage roll 26 at the loading station 44 has been transferred to the rails 94 and 96, the empty core 24 at the unwinding station 34 is moved from the unwinding station. Thus, the transfer frame drive mechanisms 198 and 200 are simultaneously actuated to pivot the drive arms 88 and 90 and the transfer frame 74 about the central axis of the core 24 of the stationary storage roll 26 at the loading station 44. Thus, the transfer frame 74 is pivoted upwardly from the lowered position shown in FIG. 2 to the raised position shown in FIG. 6. As this occurs, the relatively heavy storage roll 26 remains stationary at the loading station 44 and the empty core 24 of the preceding storage roll is moved along an arcuate path from the unwinding station 34 to the intermediate location directly above the storage roll 26 at the loading station 44.

To effect pivotal movement of the transfer frame 74 and the drive arm 88 from the lowered position of FIG. 2 to the raised position of FIG. 6, the electric motor 212 drives the vertical screw 206 to move the carriage 202 upwardly from the position shown in FIG. 2. As the carriage 202 starts to move upwardly, the drive link 204 applies an upwardly directed force against the cross member 116 of the transfer frame 74. Due to the relatively large weight of the stationary storage roll 26 at the loading station 44, the transfer frame 74 pivots about the spindle assemblies 68 and 70 in a clockwise direction from the position shown in FIG. 2. As this is occurring, the drive arm 88 is also pivoted in a clockwise direction.

When the carriage 202 reaches the upper end of the drive screw 206 (FIG. 6), the drive link 204 is generally horizontal. Both the transfer frame 74 and the drive arm 88 have moved slightly past (approximately 2°) a vertical plane extending through the central axis of the core 24 of the storage roll 26 disposed at the loading station 44. Although only the drive mechanism 198 and drive arm 88 are shown in FIGS. 2 and 6, it should be understood that the drive mechanism 200 is operated in unison with the drive mechanism 198 to move the drive arms 88 and 90 together from their lowered positions to their raised positions.

Once the empty core 24 has been positioned above the next storage roll 26 at the loading station 44, movement of the storage roll toward the unwinding station 34 begins. This is accomplished by reversing the direction of operation of the drive mechanisms 198 and 200 to allow the transfer frame 74 to slowly pivot about the center line of the storage roll 26 as the wheels 100 and 102 roll downwardly along the rails 94 and 96. The spindle assemblies 68 and 70 cooperate with the core 24 to form an axle extending between the wheels 100 and 102. This enables the wheels 100 and 102 to support the weight of the storage roll 26 as the wheels move along the inclined rails 94 and 96.

During the initial motion of the storage roll 26 and support wheels 100 and 102 along the tracks 94 and 96, the head end 180 (FIG. 5) of the spindle shaft 130 moves out of engagement with the gripper assembly 184. The gripper levers 186 do not block disengagement of the head end 180 of the spindle shaft 130 from the gripper assembly 184 by movement of the spindle assembly 68 along the rail 94.

After the spindle assemblies 68 and 70 have become disengaged from the spindle actuator assemblies 76 and 78, the spindle actuator assemblies are operated from the extended condition (FIG. 5]to the retracted condition (FIG. 4). Of course, before the spindle actuator assemblies 76 and 78 are operated to the retracted condition of FIGS. 4, the spindle assemblies 68 and 70 will have become disengaged from the spindle actuator assemblies. Therefore, retraction of the spindle actuator assemblies 76 and 78 is effective to move just the gripper assemblies 184 to the retracted position. Although only the spindle actuator assembly 76 is illustrated in FIGS. 4 and 5, it should be understood that the spindle actuator assembly 78 is operated to the retracted condition in the same manner as the spindle actuator assembly 76.

As the wheels 100 and 102 begin to roll down the rails 94 and 96, the transfer frame 74 pivots in a clockwise direction, as viewed in FIGS. 6 and 8, about the coincident central axes of the wheels 100 and 102 and core 24 of the storage roll 26. Thus, the transfer frame 74 moves from the raised position shown in FIG. 6 to the partially lowered or transient position of FIG. 8. As this occurs, the carriage 202 moves slowly down the vertical drive screw 206 in the drive mechanism 198. The rate of movement of the carriage 202 down the screw 206 determines the rate at which the wheels 100 and 102 roll along the downwardly inclined tracks 94 and 96. Of course, the drive mechanism 200 is operated in unison with the drive mechanism 198.

As the storage roll 26 moves to the unwinding station 34, the empty storage roll core moves straight down to the loading station 44. At this time, the transfer frame 74 will have been rotated end-for-end, that is through 180°, from the orientation shown in FIGS. 2 and 3. Thus, the spindle assemblies 68 and 70 will be located at the unwinding station 34 and the spindle assemblies 106 and 108 will be located at the loading station 44.

At this time, the spindle assemblies 68 and 70 cooperate with the core 24 of the storage roll 26 to form an axle interconnecting the wheels 100 and 102. Similarly, the spindle assemblies 106 and 108 cooperate with the empty roll core 24 to form an axle interconnecting the support wheels 130 and 132. Due to the relatively heavy weight of the storage roll 26, the transfer frame 74 will be tipped downwardly about the fulcrum wheels 124 and 126. The support wheels 100 and 102 are disposed in engagement with the rails 94 and 96 at the unwinding station 34 while the wheels 130 and 132 are disposed slightly above the rails 94 and 96 at the loading station 44.

Once the storage roll 26 has been moved to the unwinding station 34, the live centers 120 and 122 are moved into engagement with the spindle assemblies 68 and 70. Thus, the live center 120 moves into engagement with the head end 180 of the spindle shaft 130 of the spindle assembly 68. Similarly, the live center 122 engages the head end of the spindle shaft in the spindle assembly 70. The live centers 120 and 122 raise the storage roll 26 to pivot the transfer frame 74 through a small distance about the fulcrum wheels 124 and 126. Therefore, the weight of the transfer frame 74 is carried by the fulcrum wheels 124 and 126 at the cross member 116.

The belt drive assembly 36 (FIG. 1) of the infeed unit 30 of the rewind assembly 22 engages the periphery of the storage roll 26 and rotates the storage roll about the central axes of the spindle assemblies 68 nd 70. As the storage roll 26 is rotated about the central axes of the spindle assemblies 68 and 70, the web 32 of toilet tissue is fed to the infeed unit 30, intermediate unit 40 and rewind unit 42 of the rewind assembly 22.

After the empty roll core 24 has been moved to the loading station 44, the lift assemblies 56 and 58 are operated by the controller 262 to raise the cradle 50 to a position immediately beneath the empty core. The spindle actuator assemblies 76 and 78 are then operated to engage the head ends of the spindle shafts of the spindle assemblies 106 and 108. Thus, the spindle actuator assembly 76 is operated from the retracted condition of FIG. 4 to the extended condition of FIG. 5. As this occurs, the gripper levers 186 move into engagement with the head end of the spindle shaft for the spindle assembly 106. Thus, the gripper levers 186 are pivoted outwardly against the influence of the biasing springs 188 by engagement of the gripper levers with the head end of the spindle shaft. The gripper levers 186 are then snapped into place over the head end of the spindle shaft.

The actuator assemblies 76 and 78 are then operated from the extended condition (FIG. 5) to the retracted condition (FIG. 4) to disengage the core plugs (FIG. 7) of the spindle assemblies 106 and 108 from the empty roll core 24. As this occurs, the empty roll core 24 drops downwardly onto the raised cradle 54.

Once the empty roll core 24 has dropped onto the cradle 50, the transfer car 48 is moved from the pickup and delivery station 54 to the loading station 44. This positions the arms 230 and 232 of the transfer car 48 immediately beneath the cradle 50. The lift assemblies 56 and 58 are then operated to lower the cradle 50 downwardly onto the transfer car 48.

After the lift assemblies 56 and 58 have been retracted below the cradle 50 (FIG. 7), the transfer car 48 is moved from the loading station 44 (FIG. 3) to the pickup and delivery station 54 (FIG. 1) to position the cradle 50 and empty roll 24 core for engagement by the vehicle 52. The vehicle 52 is then moved beneath the cradle 50. The turntable 222 is raised to disengage the cradle 50 from the transfer car 48. The turntable 222 is then rotated to move the empty roll core 24 to a position in which the longitudinal central axis of the roll core is perpendicular to the central axis of the storage roll 26 at the unwinding station 34. The vehicle 52 then carries the empty cradle 50 and the roll core 24 to a receiving location.

Once approximately 60% of the material has been unwound from the storage roll 26 at the unwinding station 34, the foregoing process is repeated and a next succeeding storage roll 26 is moved to the loading station 44 and engaged by the spindle assemblies 106 and 108 on the transfer frame 74. After the toilet tissue has been completely unwound from the storage roll 26 at the unwinding station 34, so that only the empty core 24 remains at the unwinding station 26, the transfer frame is again pivoted in a clockwise direction from the lowered position of FIG. 2 to the raised position of FIG. 6. This moves the empty roll core 24 to the intermediate position above the stationary storage roll 26 at the loading station 44. The clockwise rotational movement of the transfer frame 74 is then continued as next succeeding storage roll 26 is moved down the rails 94 and 96 to the unwinding station 34. As the next storage roll 26 moves to the unwinding station 34, the empty roll core 24 and spindle assemblies 68 and 70 move back to the loading station 44.

SUMMARY

In view of the foregoing description, it is apparent that the present invention provides a new and improved material handling method and apparatus 20 for handling large storage rolls 26 of toilet tissue and empty roll cores 24. Although the present invention provides a material handling apparatus and method which are advantageously used to sequentially move large rolls 26 of toilet tissue having cores 24, it is contemplated that the material handling apparatus and method of the present invention can be used with many different types of material. Thus, the material handling method and apparatus 20 of the present invention can be used to handle either cylindrical or noncylindrical rolls of material to be fed to many different types of mechanisms during a manufacturing process. Therefore, the invention should not be considered as being limited to the handling of rolls of any particular type of material. However, it is believed that the invention will be particularly advantageous in handling large, noncylindrical rolls of material.

The material handling apparatus 20 of the present invention includes a frame assembly 72 having spindle assemblies 68 and 70 for holding a first roll 26 by its core 24 during movement of the first roll from the loading station 44 to the unwinding station 34. The spindle assemblies 68 and 70 also hold the empty core 24 of the first roll during movement of the empty core from the unwinding station 34 back to the loading station 44. The frame assembly 72 also has a second pair of spindle assemblies 106 and 108 which hold a second roll 26 by its core 24 during movement of the second roll from the loading station 44 to the unwinding station 34. The spindle assemblies 106 and 108 also hold the empty core 24 of the second roll during movement of the empty core of the second roll from the unwinding station back 34 to the loading station 44.

To facilitate movement of a roll 26 from the loading station 44 to the unwinding station 34, wheels 100 and 102 or 130 and 132 are connected with opposite ends of the core 24 of a roll 26. During movement of the roll 26 from the loading station 44 to the unwinding station 34, the wheels 100 and 102 or 130 and 132 roll along rails 94 and 96 extending from the loading station to the unwinding station. During movement of the empty core 24 of the first roll 26 from the unwinding station 34 to the loading station 44, the wheels 100 and 102 or 130 and 132 are disengaged from the rails 94 and 96. In the illustrated embodiment of the material handling apparatus 20, storage rolls 26 are moved along a linear path from the loading station 44 to the unwinding station 34. However, the empty cores 24 are moved from the unwinding station 34 to the loading station 44 along a path having an arcuate segment and a linear segment.

Once the material has been unwound from a core 24 at the unwinding station 34, the empty core 24 is moved to an intermediate position above the loading station 44 (FIG. 6). As the next roll 26 of material is moved from the loading station 44 to the unwinding station 34 (FIG. 8), the empty core 24 is moved straight downwardly to the loading station During movement of the roll 26 from the loading station 44 to the unwinding station 34 and movement of an empty core 24 from the unwinding station back to the loading station, the frame assembly 72 is turned end-for-end with a roll 26 at one end of the frame and assembly an empty core 24 at the other end of the frame assembly.

When the method and apparatus 20 of the present invention are used to handle noncylindrical rolls 26 of material, the core 24 of the noncylindrical roll is moved to a horizontal orientation before the roll is engaged by the frame assembly 72. A pair of lift assemblies 56 and 58 (FIG. 7) are provided to support opposite ends of the roll 26. Each of the lift assemblies 56 and 58 is operated to move one end of the roll 26 until a sensor assembly 270 or 272 (FIG. 9) detects that an end of a roll core 24 has been moved to a predetermined level Having described the invention, the following is claimed:

1. An apparatus for use in sequentially moving rolls of material having cores from a loading station to a unwinding station and for sequentially moving empty roll cores from the unwinding station back to the loading station, said apparatus comprising frame means having a first end portion for holding a first roll by its core during movement of the first roll from the loading station to the unwinding station and for holding the empty core of the first roll during movement of the core of the first roll from the unwinding station back to the loading station, said frame means having a second end portion for holding a second roll by its core during movement of the second roll from the loading station to the unwinding station and for holding the empty core of the second roll during movement of the core of the second roll from the unwinding station to the loading station, and drive means for pivoting said frame means about a central axis of the core of the second roll while the second roll is stationary at the loading station to move the empty core of the first roll from the unwinding station toward the loading station.

2. An apparatus as set forth in claim 1 wherein said frame means extends from the loading station to the unwinding station when the empty core of the first roll is at the unwinding station and the second roll is at the loading station.

3. An apparatus as set forth in claim 1 wherein said frame means includes a first longitudinal member extending between the first and second end portions of said frame means, and a second longitudinal member extending between the first and second end portions of said frame means, said first and second members extending parallel to each other and being spaced apart from each other by a distance which is at least as great as the axial extent of one of the rolls to enable the rolls to be sequentially positioned between said members, said first and second members each having a length which is as great as the distance from the loading station to the unwinding station to enable the second roll to be positioned between the first and second members at the loading station while the empty core of the first roll is disposed between the first and second members at the unwinding station.

4. An apparatus as set forth in claim 3 further including first lift means at the loading station for supporting a first end portion of the second roll and second lift means at the loading station for supporting a second end portion of the second roll opposite from the first end portion, said first lift means including first motor means to raise the first end portion of the second roll to a position in which a first end portion of the core of the second roll is disposed at the loading station adjacent to an end portion of the first member, said second lift means including second motor means to raise the second end portion of the second roll to a position in which a second end portion of the core of the second roll is disposed at the loading station at the same level as the first end portion of the core of the second roll and is adjacent to an end portion of the second member.

5. An apparatus for use in sequentially moving rolls of material having cores from a loading station to an unwinding station and for sequentially moving empty roll cores from the unwinding station back to the loading station, said apparatus comprising frame means having a first end portion for holding a first roll by its core during movement of the first roll from the loading station to the unwinding station and for holding the empty core of the first roll during movement of the empty core of the first roll from the unwinding station back to the loading station, said frame means having a second end portion for holding a second roll by its core during movement of the second roll from the loading station to the unwinding station and for holding the empty core of the second roll during movement of the empty core of the second roll from the unwinding station back to the loading station, first and second tracks extending from the loading station to the unwinding station, said first end portion of said frame means including first wheel means for engaging said first track and second wheel means for engaging said second track to support the weight of the first roll on said first and second tracks during movement of the first roll from the loading station to the unwinding station, said second end portion of said frame means including third wheel means for engaging said first track and fourth wheel means for engaging said second track to support the weight of the second roll on said first and second tracks during movement of said second roll from the loading station to the unwinding station, and drive means connected with said frame means for moving said frame means to move the first roll from the loading station to the unwinding station, said drive means being operable to move said frame means to move the second roll from the loading station to the unwinding station and to move the empty core of the first roll from the unwinding station to the loading station.

6. An apparatus as set forth in claim 5 further including first and second fulcrum means connected with said frame means, said first fulcrum means engaging said first track and said second fulcrum means engaging said second track to at least partially support said frame means when the first end portion of said frame means is at the unwinding station and to at least partially support said frame means when the second end portion of said frame means is at the unwinding station.

7. An apparatus as set forth in claim 5 further including a base, said drive means including a first drive arm having one end portion pivotally connected with said base and another end portion connected with a central portion of said frame means, a second drive arm having one end portion pivotally connected with said base and another end portion connected with the central portion of said frame means, and motor means for pivoting said first and second drive arms relative to said base to rotate said frame means relative to said base.

8. An apparatus as set forth in claim 5 further including first lift means at the loading station for supporting a first end portion of a roll and second lift means at the loading station for supporting a second end portion of the roll opposite from the first end portion, and control means for effecting operation of said first and second lift means to raise each of the rolls in turn to a loading position with a central axis of the core of each of the rolls horizontal.

9. An apparatus as set forth in claim 8 wherein the core of each of the rolls is hollow, said control means including means for transmitting a beam into the core of each of the rolls in turn while the first end portion of each of the rolls is supported by said first lift means and the second end of each of the rolls is supported by said second lift means.

10. An apparatus as set forth in claim 5 further including lift means at the loading station for supporting the first roll and control means for effecting operation of said lift means to raise the first roll to a position in which the first roll is between said first and second wheel means when said first end portion of said frame means is at the loading station, said lift means being operable to support the second roll, said control means being operable to effect operation of said lift means to raise the second roll to a position in which the second roll is between said third and fourth wheel means when said second end portion of said frame means is at the loading station.

11. An apparatus as set forth in claim 5 wherein said first end portion of said frame means includes first spindle means for connecting said first wheel means with a first end portion of the core of the first roll and second spindle means for connecting said second wheel means with a second end portion of the core of the first roll so that the core of the first roll at least partially forms an axle extending between said first and second wheel means, said second end portion of said frame means including a third spindle means for connecting said third wheel means with a first end portion of the core of the second roll and fourth spindle means for connecting said fourth wheel means with the second end portion of the core of the second roll so that the core of the second roll at least partially forms an axle extending between said third and fourth wheel means.

12. An apparatus as set forth in claim 11 further including first motor means at said loading station for moving said first spindle means into engagement with the core of the first roll and for moving said third spindle means into engagement with the core of the second roll, and second motor means at said loading station for moving said second spindle means into engagement with the core of the first roll and for moving said fourth spindle means into engagement with the core of the second roll.

13. An apparatus as set forth in claim 5 wherein said drive means is operable to pivot said frame means about axes of said third and fourth wheel means to move said first and second wheel means and the core of the first roll from the unwinding station to the loading station, said drive means being operable to pivot said frame means about the axes of said first and second wheel means to move said third and fourth wheel means and the core of the second roll from the unwinding station to the loading station.

14. An apparatus as set forth in claim 5 wherein said frame means is pivotal about axes of said first and second wheel means as said first and second wheel means roll along said first and second tracks from the loading station to the unwinding station and is pivotal about axes of said third and fourth wheel means as said third and fourth wheel means roll along said first and second tracks from the loading station to the unwinding station.

15. An apparatus as set forth in claim 14 wherein said frame means is pivotal about the axes of said third and fourth wheel means to move said first and second wheel means and the core of the first roll from the unwinding station toward the loading station while said third and fourth wheel means are stationary at the loading station.

16. An apparatus as set forth in claim 5 wherein said first and second wheel means are spaced apart from first and second tracks during movement of the empty core of the first roll from the unwinding station to the loading station.

17. An apparatus as set forth in claim 5 wherein said first and second tracks are linear and slope downwardly from the loading station to the unwinding station, said first and second wheel means being movable in a straight path along said first and second tracks under the influence of gravity during movement of the first roll from the loading station to the unwinding station, said third and fourth wheel means being movable in a straight path along said first and second tracks under the influence of gravity during movement of the second roll from the loading station to the unloading station.

18. An apparatus as set forth in claim 17 wherein said drive means is operable to move the empty core of the first roll along a nonlinear path from the unwinding station to the loading station with said first and second wheel means spaced from said first and second tracks and with said third and fourth wheel means in engagement with said first and second tracks.

19. An apparatus for use in sequentially moving rolls of material having cores from a loading station to an unwinding station and for sequentially moving empty roll cores from the unwinding station back to the loading station, said apparatus comprising frame means having a first end portion for holding a first roll by its core during movement of the first roll from the loading station to the unwinding station and for holding the empty core of the first roll during movement of the empty core of the first roll from the unwinding station back to the loading station, said frame means having a second end portion for holding a second roll by its core during movement of the second roll from the loading station to the unwinding station and for holding the empty core of the second roll during movement of the empty core of the second roll from the unwinding station back to the loading station, and drive means connected with said frame means for moving said frame means to move the first roll from the loading station to the unwinding station, said drive means being operable to move said frame means to move the second roll from the loading station to the unwinding station and to move the empty core of the first roll from the unwinding station to the loading station, said drive means including means for pivoting said frame means about said second end portion of said frame means to move the empty core of the first roll and the first end portion of said frame means from said unwinding station to an intermediate location above the loading station while the second roll remains stationary at the loading station, and for pivoting said frame means about the second end portion of said frame means as the second roll moves from the loading station to the unwinding station to move said first end portion of said frame means and the empty core of the first roll downwardly from the intermediate location to the loading station.

20. An apparatus as set forth in claim 19 wherein said drive means is operable to pivot said frame means about said first end portion to move the empty core of the second roll and the second end portion of said frame means from the unwinding station to the intermediate location above the loading station.

21. An apparatus as set forth in claim 19 wherein said first end portion of said frame means and the empty core of the first roll move along an arcuate path from the unwinding station to the intermediate location and move along a linear path from the intermediate location to the loading station.

22. An apparatus as set forth in claim 21 wherein said second end portion of said frame means and the second roll move along a linear path from the loading station to the unwinding station.

23. An apparatus as set forth in claim 19 wherein said drive means includes a carriage which is connected with said frame means and is movable in a first direction along a linear path during pivoting of said frame means about said second end potion of said frame means and movement of said first end portion of said frame means from the unwinding station to the intermediate location, said carriage being movable in a second direction along the linear path during pivoting of said frame means about said second end portion of said frame means and movement of said first end portion of said frame means from the intermediate location to the loading station.

24. An apparatus as set forth in claim 19 further including fulcrum means connected with a central portion of said frame means for at least partially supporting said frame means when said first end portion of said frame means is at the unwinding station, said fulcrum means being movable with said frame means to a location above the loading station during movement of the first end portion of said frame means to the intermediate location.

25. An apparatus as set forth in claim 24 wherein said fulcrum means moves from the location above the loading station to a location between the loading station and the unwinding station during movement of the first end portion of said frame means to the loading station.

26. An apparatus for use in sequentially moving rolls of material having cores from a loading station to an unwinding station and for sequentially moving empty roll cores from the unwinding station back to the loading station, said apparatus comprising frame means having a first end portion for holding a first roll by its core during movement of the first roll from the loading station to the unwinding station and for holding the empty core of the first roll during movement of the empty core of the first roll from the unwinding station back to the loading station, said frame means having a second end portion for holding a second roll by its core during movement of the second roll from the loading station to the unwinding station and for holding the empty core of the second roll during movement of the empty core of the second roll from the unwinding station back to the loading station, and drive means connected with said frame means for moving said frame means to move the first roll from the loading station to the unwinding station, said drive means being operable to move said frame means to move the second roll from the loading station to the unwinding station and to move the empty core of the first roll from the unwinding station to the loading station, said frame means being pivotal about the first end portion of said frame means during movement of the first roll and the first end portion of said frame means from the loading station to the unwinding station and being pivotal about the second end portion of said frame means during movement of the second roll and the second end portion of said frame means from the loading station to the unwinding station.

27. An apparatus as set forth in claim 26 wherein said drive means is operable to pivot said frame means about the second end portion of said frame means to move the first end portion of said frame means and the empty core of the first roll from the unwinding station toward the loading station, said drive means being operable to pivot said frame means about the first end portion of said frame means to move the second end portion of said frame means and the empty core of the second roll from the unwinding station toward the loading station.

28. An apparatus as set forth in claim 26 wherein the second end portion of said frame means and empty core of one of the rolls is movable downwardly toward the loading station during pivotal movement of said frame means about the first end portion of said frame means and the first end portion of said frame means and empty core of one of the rolls is movable downwardly toward the loading station during pivotal movement of said frame means about the second end portion of said frame means.

29. An apparatus as set forth in claim 26 wherein said frame means includes a first longitudinal member extending between the first and second end portions of said frame means, and a second longitudinal member extending between the first and second end portions of said frame means, said first and second members extending parallel to each other and being spaced apart from each other by a distance which is at least as great as the axial extent of one of the rolls to enable the rolls to be sequentially positioned between said first and second members, said first and second members each having a length which is at least as great as the distance from the loading station to the unwinding station.

30. An apparatus as set forth in claim 29 further including first fulcrum means connected with a central portion of said first member and second fulcrum means connected with a central portion of said second member, said first and second fulcrum means at least partially supporting said first and second members when the first end portion of said frame means is at the unwinding station and at least partially supporting said first and second members when the second end portion of said frame means is at the unwinding station.

31. An apparatus as set forth in claim 29 further including a base, said drive means including a first drive arm having one end portion pivotally connected with said base and another end portion connected with a central portion of said first member, a second drive arm having one end portion pivotally connected with said base and another end portion connected with a central portion of said second member, and motor means for pivoting said first and second drive arms relative to said base to rotate said first and second members relative to said base.

32. An apparatus as set forth in claim 29 further including first lift means at the loading station for supporting a first end portion of a roll and second lift means at the loading station for supporting a second end portion of the roll opposite from the first end portion, and control means for effecting operation of said first and second lift means to raise each of the rolls in turn to a loading position with a central axis of the core of each of the rolls horizontal.

33. An apparatus as set forth in claim 32 wherein the core of each of the rolls is hollow, said control means including means for transmitting a beam into the core of each of the rolls in turn while the first end portion of each of the rolls is supported by said first lift means and the second end of each of the rolls is supported by said second lift means.

34. An apparatus as set forth in claim 26 wherein said drive means is operable to pivot said frame means about said second end portion of said frame means to move the empty core of the first roll and the first end portion of said frame means from said unwinding station to an intermediate location above the loading station, said first end portion of said frame means and the empty core of the first roll being movable from the intermediate location to the loading station during pivotal movement of said frame means about the second end portion of said frame means during movement of the second roll and the second end portion of said frame means to the unwinding station.

35. An apparatus as set forth in claim 26 wherein said drive means includes a carriage which is movable in a first direction along a linear path during pivotal movement of said frame means about the first end portion of said frame means during movement of the first roll and the first end portion of said frame means form the loading station to the unwinding station, said carriage being movable in the first direction along the linear path during pivotal movement of said frame means about the second ene portion of said frame means during movement of the second roll and second end portion of said frame means from the loading station to the unwinding station.

36. An apparatus as set forth in claim 26 further including fulcrum means connected with a central portion of said frame means for at least partially supporting said frame means when the first end portion of said frame means is at the unwinding station and for at least partially supporting said frame means when the second end portion of said frame means is at the unwinding station.

37. An apparatus as set forth in claim 26 wherein said frame means includes first spindle means for connecting the first end portion of said frame with a first end portion of the core of the first roll, second spindle means for connecting the first end portion of said frame with a second end portion of the core of the first roll, third spindle means for connecting the second end portion of said frame with a first end portion of the core of the second roll and fourth spindle means for connecting the second end portion of said frame with a second end portion of the core of the second roll.

38. An apparatus as set forth in claim 37 further including first motor means at the loading station for moving said first spindle means into engagement with the first end portion of the core of the first roll and for moving said third spindle means into engagement with the first end portion of the core of the second roll, and second motor means at the loading station for moving said second spindle means into engagement with the second end portion of the core of the first roll and for moving said fourth spindle means into engagement with the second end portion of the core of the second roll.

39. An apparatus for use in sequentially moving rolls of material having cores from a loading station to an unwinding station and for sequentially moving empty roll cores from the unwinding station back to the loading station, said apparatus comprising frame means having a first end portion for holding a first roll by its core during movement of the first roll from the loading station to the unwinding station and for holding the empty core of the first roll during movement of the empty core of the first roll from the unwinding station back to the loading station, said frame means having a second end portion for holding a second roll by its core during movement of the second roll from the loading station to the unwinding station and for holding the empty core of the second roll during movement of the empty core of the second roll from the unwinding station back to the loading station, said frame means including a first longitudinal member extending between the first and second end portions of said frame means, and a second longitudinal member extending between the first and second end portions of said frame means, said first and second members extending parallel to each other and being spaced apart from each other by a distance which is at least as great as the axial extent of one of the rolls to enable the rolls to be sequentially positioned between said first and second members, said first and second members each having a length which is at least as great as the distance from the loading station to the unwinding station, a base, and drive means connected with said frame means for moving said frame means to move the first roll from the loading station to the unwinding station, said drive means being operable to move said frame means to move the second roll from the loading station to the unwinding station and to move the empty core of the first roll from the unwinding station to the loading station, said drive means including a first drive arm having one end portion pivotally connected with said base and another end portion connected with a central portion of said first member, a second drive arm having one end portion pivotally connected with said base and another end portion connected with a central portion of said second member, and motor means for pivoting said first and second drive arms relative to said base to rotate said first and second members relative to said base.

40. An apparatus as set forth in claim 39 further including first fulcrum means connected with a central portion of said first member and second fulcrum means connected with a central portion of said second member, said first and second fulcrum means at least partially supporting said first and second members when the first end portion of said frame means is at the unwinding station and at least partially supporting said first and second members when the second end portion of said frame means is at the unwinding station.

41. An apparatus as set forth in claim 39 further including first lift means at the loading station for supporting a first end portion of a roll and second lift means at the loading station for supporting a second end portion of the roll opposite from the first end portion, and control means for effecting operation of said first and second lift means to raise each of the rolls in turn to a loading position with a central axis of the core of each of the rolls horizontal.

42. An apparatus for use in sequentially moving rolls of material having cores from a loading station to an unwinding station and for sequentially moving empty roll cores from the unwinding station back to the loading station, said apparatus comprising frame means having a first end portion for holding a first roll by its core during movement of the first roll from the loading station to the unwinding station and for holding the empty core of the first roll during movement of the core of the first roll from the unwinding station back to the loading station, said frame means having a second end portion for holding a second roll by its core during movement of the second roll from the loading station to the unwinding station and for holding the empty core of the second roll during movement of the core of the second roll from the unwinding station to the loading station, and drive means for pivoting said frame means about a central axis of the core of the second roll while the second roll is stationary at the loading station to move the empty core of the first roll from the unwinding station toward the loading station, said frame means being pivotal about the core of the second roll during movement of the second roll from the loading station to the unwinding station to move the empty core of the first roll to the unloading station as the second roll moves to the unwinding station.

43. An apparatus as set forth in claim 42, further including first and second tracks extending from the loading station to the unwinding station, a first wheel movable along said first track and rotatably mounted on the first end portion of said frame means, a second wheel movable along said second track and rotatably mounted on the first end portion of said frame means, a third wheel movable along said first track and rotatably mounted on the second end portion of said frame means, and a fourth wheel movable along said second track and rotatably mounted on the second end portion of said frame means.

44. An apparatus as set forth in claim 43 wherein said first and second tracks are linear and slope downwardly from said loading station to said unwinding station, said first and second wheels being disposed in rolling engagement with said first and second tracks during movement of the first roll along a straight path extending from the loading station to the unwinding station, said third and fourth wheels being disposed in rolling engagement with said first and second tracks during movement of the second roll along the straight path which extends from the loading station to the unwinding station.

45. An apparatus as set forth in claim 42 wherein said frame means extends from the loading station to the unwinding station when the empty core of the first roll is at the unwinding station and the second roll is at the loading station.

46. An apparatus as set forth in claim 42 wherein said drive means is operable to pivot said frame means through a distance sufficient to move the empty core of the first roll from the unwinding station to a location above the loading station during operation of said drive means to pivot said frame means about a central axis of the core of the second roll while the core of the second roll is stationary at the loading station.

47. An apparatus as set forth in claim 42 wherein said frame means includes a first longitudinal member extending between the first and second end portions of said frame means, and a second longitudinal member extending between the first and second end portions of said frame means, said first and second members extending parallel to each other and being spaced apart from each other by a distance which is at least as great as the axial extent of one of the rolls to enable the rolls to be sequentially positioned between said members.

48. An apparatus as set forth in claim 47 further including first lift means at the loading station for supporting a first end portion of the second roll and second lift means at the loading station for supporting a second end portion of the second roll opposite from the first end portion, said first lift means including first motor means to raise the first end portion of the second roll to a position in which a first end portion of the core of the second roll is disposed at the loading station adjacent to an end portion of the first member, said second lift means including second motor means to raise the second end portion of the second roll to a position in which a second end portion of the core of the second roll is disposed at the loading station at the same level as the first end portion of the core of the second roll and is adjacent to an end portion of the second member.

49. An apparatus as set forth in claim 48 further including control means for determining when a central axis of the core of the second roll is horizontal, said control means including first sensor means for detecting a beam reflected from a first end portion of the core of the second roll while the first end portion of the second roll is supported by said first lift means and second sensor means for detecting a beam reflected from a second end portion of the core of the first roll while the second end portion of the second roll is supported by said second lift means.

50. An apparatus as set forth in claim 42 further including a first lift assembly for raising a first end portion of each of the rolls of material in turn, a second lift assembly for raising a second end portion of each of the rolls of material in turn, first sensor means for detecting when a first end portion of a core of each of the rolls of material in turn is raised to a predetermined level, second sensor means for detecting when a second end portion of the core of each of the rolls of material in turn is raised to the predetermined level, and control means for interrupting operation of said first lift assembly in response to said first sensor means detecting that the first end portion of a core of a roll of material is at the predetermined level and for interrupting operation of said second lift assembly in response to said second sensor means detecting that the second end portion of a core of a roll of material is at the predetermined level.

51. An apparatus as set forth in claim 50 wherein said first sensor means includes means for directing a first beam of light toward the first end portion of a core of each of the rolls of material in turn and photoelectric means for detecting light reflected from the first end portion of a core of each of the rolls of material in turn, said second sensor means including means for directing a second beam of light toward the second end portion of a core of each of the rolls of material in turn and photoelectric means for detecting light reflected from the second end portion of a core of each of the rolls of material in turn.

52. An apparatus for use in sequentially moving rolls of material having cores from a loading station to an unwinding station and for sequentially moving empty roll cores from the unwinding station back to the loading station, said apparatus comprising first lift means at the loading station for supporting a first end portion of a roll and second lift means at the loading station for supporting a second end portion of the roll opposite from the first end portion, and control means for effecting operation of said first and second lift means to raise each of the rolls in turn to a loading position with a central axis of the core of each of the rolls horizontal, the core of each of the rolls is hollow, said control means including means for transmitting a beam into the core of each of the rolls in turn while the first end portion of each of the rolls is supported by said first lift means and the second end portion of each of the rolls is supported by said second lift means, frame means having a first end portion for holding a first roll by its core during movement of the first roll from the loading station to the unwinding station and for holding the empty core of the first roll during movement of the empty core of the first roll from the unwinding station back to the loading station, said frame means having a second end portion for holding a second roll by its core during movement of the second roll from the loading station to the unwinding station and for holding the empty core of the second roll during movement of the empty core of the second roll from the unwinding station back to the loading station, and drive means connected with said frame means for moving said frame means to move the first roll from the loading station to the unwinding station, said drive means being operable to move said frame means to move the second roll from the loading station to the unwinding station and to move the empty core of the first roll from the unwinding station to the loading station.

53. An apparatus for use in sequentially moving rolls of material having cores from a loading station to an unwinding station and for sequentially moving empty roll cores from the unwinding station back to the loading station, said apparatus comprising frame means having a first end portion for holding a first roll by its core during movement of the first roll from the loading station to the unwinding station and for holding the empty core of the first roll during movement of the core of the first roll from the unwinding station back to the loading station, said frame means having a second end portion for holding a second roll by its core during movement of the second roll from the loading station to the unwinding station and for holding the empty core of the second roll during movement of the core of the second roll from the unwinding station to the loading station, and drive means for pivoting said frame means about a central axis of the core of the second roll while the second roll is stationary at the loading station to move the empty core of the first roll from the unwinding station toward the loading station, said drive means being operable to pivot said frame means through a distance sufficient to move the empty core of the first roll from the unwinding station to a location above the loading station during operation of said drive means to pivot said frame means about a central axis of the core of the second roll while the core of the second roll is stationary at the loading station.

54. An apparatus as set forth in claim 53 further including first and second tracks extending from the loading station to the unwinding station, a first wheel movable along said first track and rotatably mounted on the first end portion of said frame means, a second wheel movable along said second track and rotatably mounted on the first end portion of said frame means, a third wheel movable along said first track and rotatably mounted on the second end portion of said frame means, and a fourth wheel movable along said second track and rotatably mounted on the second end portion of said frame means.

55. An apparatus as set forth in claim 54 wherein said first and second tracks are linear and slope downwardly from said loading station to said unwinding station, said first and second wheels being disposed in rolling engagement with said first and second tracks during movement of the first roll along a straight path extending from the loading station to the unwinding station, said third and fourth wheels being disposed in rolling engagement with said first and second tracks during movement of the second roll along the straight path which extends from the loading station to the unwinding station.

56. An apparatus as set forth in claim 53 wherein said frame means extends from the loading station to the unwinding station when the empty core of the first roll is at the unwinding station and the second roll is at the loading station.

57. An apparatus as set forth in claim 53 wherein said frame means includes a first longitudinal member extending between the first and second end portions of said frame means, and a second longitudinal member extending between the first and second end portions of said frame means, said first and second members extending parallel to each other and being spaced apart from each other by a distance which is at least as great as the axial extent of one of the rolls to enable the rolls to be sequentially positioned between said members.

58. An apparatus as set forth in claim 57 further including first lift means at the loading station for supporting a first end portion of the second roll and second lift means at the loading station for supporting a second end portion of the second roll opposite from the first end portion, said first lift means including first motor means to raise the first end portion of the second roll to a position in which a first end portion of the core of the second roll is disposed at the loading station adjacent to an end portion of the first member, said second lift means including second motor means to raise the second end portion of the second roll to a position in which a second end portion of the core of the second roll is disposed at the loading station at the same level as the first end portion of the core of the second roll and is adjacent to an end portion of the second member.

59. An apparatus as set forth in claim 58 further including control means for determining when a central axis of the core of the second roll is horizontal, said control means including first sensor means for detecting a beam reflected from a first end portion of the core of the second roll while the first end portion of the second roll is supported by said first lift means and second sensor means for detecting a beam reflected from a second end portion of the core of the first roll while the second end portion of the second roll is supported by said second lift means.

60. An apparatus as set forth in claim 53 further including a first lift assembly for raising a first end portion of each of the rolls of material in turn, a second lift assembly for raising a second end portion of each of the rolls of material in turn, first sensor means for detecting when a first end portion of a core of each of the rolls of material in turn is raised to a predetermined level, second sensor means for detecting when a second end portion of the core of each of the rolls of material in turn is raised to the predetermined level, and control means for interrupting operation of said first lift assembly in response to said first sensor means detecting that the first end portion of a core of a roll of material is at the predetermined level and for interrupting operation of said second lift assembly in response to said second sensor means detecting that the second end portion of a core of a roll of material is at the predetermined level.

61. An apparatus as set forth in claim 60 wherein said first sensor means includes means for directing a first beam of light toward the first end portion of a core of each of the rolls of material in turn and photoelectric means for detecting light reflected from the first end portion of a core of each of the rolls of material in turn, said second sensor means including means for directing a second beam of light toward the second end portion of a core of each of the rolls of material in turn and photoelectric means for detecting light reflected from the second end portion of a core of each of the rolls of material in turn.

62. An apparatus for use in sequentially moving rolls of material having cores from a loading station to an unwinding station and for sequentially moving empty roll cores from the unwinding station back to the loading station, said apparatus comprising frame means having a first end portion for holding a first roll by its core during movement of the first roll from the loading station to the unwinding station and for holding the empty core of the first roll during movement of the core of the first roll from the unwinding station back to the loading station, said frame means having a second end portion for holding a second roll by its core during movement of the second roll from the loading station to the unwinding station and for holding the empty core of the second roll during movement of the core of the second roll from the unwinding station to the loading station, said frame means includes a first longitudinal member extending between the first and second end portions of said frame means, and a second longitudinal member extending between the first and second end portions of said frame means, said first and second members extending parallel to each other and being spaced apart from each other by a distance which is at least as great as the axial extent of one of the rolls to enable the rolls to be sequentially positioned between said members, said first and second members reach having a length which is as great as the distance from the loading station to the unwinding station to enable the second roll to be positioned between the first and second members at the loading station while the empty core of the first roll is disposed between the first and second members at the unwinding station, first lift means at the loading station for supporting a first end portion of the second roll and second lift means at the loading station for supporting a second end portion of the second roll opposite from the first end portion, said first lift means including first motor means to raise the first end portion of the second roll to a position in which a first end portion of the core of the second roll is disposed at the loading station adjacent to as end portion of the first member, said second lift means including second motor means to raise the second end portion of the second roll to a position in which a second end portion of the core of the second roll is disposed at the loading station at the same level as the first end portion of the core of the second roll and is adjacent to an end portion of the second member, control means for determining when a central axis of the core of the second roll is horizontal, said control means including first photoelectric sensor means for detecting light reflected from a first end portion of the core of the second roll while the first end portion of the second roll is supported by said first lift means and second photoelectric means for detecting light reflected from a second end portion of the core of the first roll while the second end portion of the second roll is supported by said second lift means, and drive means for pivoting said frame means about a central axis of the core of the second roll while the second roll is stationary at the loading station to move the empty core of the first roll from the unwinding station toward the loading station.

63. An apparatus for use in sequentially moving rolls of material having cores from a loading station to an unwinding station and for sequentially moving empty roll cores from the unwinding station back to the loading station, said apparatus comprising a first lift assembly for moving a first end portion of each of the rolls in turn upwardly toward the loading station, a second lift assembly for moving a second end portion of each of the rolls in turn upwardly toward the loading station, first sensor means for detecting when a first end portion of a core of each of the rolls in turn moves to a predetermined level, second sensor means for detecting when a second end portion of the core of each of the rolls in turn moves to the predetermined level, control means for interrupting operation of said first lift assembly in response to said first sensor means detecting that the first end portion of a core of a roll is at the predetermined level and for interrupting operation of said second lift assembly in response to said second sensor means detecting that the second end portion of a core of a roll is at the predetermined level, frame means having a first end portion for engaging the first and second end portions of the core of a first roll at the loading station while the first and second end portions of the core of the first roll are at the same level, said first end portion of said frame means holding the first roll by its core during movement of the first roll from the loading station to the unwinding station and holding the empty core of the first roll during movement of the empty core of the first roll from the unwinding station back to the loading station, said frame means having a second end portion for engaging the first and second end portions of the core of a second roll at the loading station while the first and second end portions of the core of the second roll are at the same level, said second end portion of said frame means holding the second roll by its core during movement of the second roll from the loading station to the unwinding station and holding the empty core of the second roll during movement of the empty core of the second roll from the unwinding station back to the loading station, said frame means being pivotal about the first end portion of said frame means during movement of the first roll and the first end portion of said frame means from the loading station to the unwinding station and being pivotal about the second end portion of said frame means during movement of the second roll and the second end portion of said frame means from the loading station to the unwinding station, and drive means connected with said frame means for moving said frame means to move the first roll from the loading station to the unwinding station, said drive means being operable to move said frame means to move the second roll from the loading station to the unwinding station and to move the empty core of the first roll from the unwinding station to the loading station.

64. An apparatus as set forth in claim 63 wherein said first sensor means includes means for directing a first beam toward the first end portion of a core of each of the rolls of material in turn and means for detecting a beam reflected from the first end portion of a core of each of the rolls of material in turn, said second sensor means including means for directing a second beam toward the second end portion of a core of each of the rolls of material in turn and means for detecting a beam reflected from the second end portion of a core of each of the rolls of material in turn.

65. An apparatus as set forth in claim 63 further including first and second tracks extending from the loading station to the unwinding station, said first end portion of said frame means including first wheel means for engaging said first track and second wheel means for engaging said second track to support the weight of the first roll on said first and second tracks during movement of the first roll from the loading station to the unwinding station, said second end portion of said frame means including third wheel means for engaging said first track and fourth wheel means for engaging said second track to support the weight of the second roll on said first and second tracks during movement of said second roll from the loading station to the unwinding station.

66. An apparatus as set forth in claim 65 wherein said first and second tracks slope downwardly from the loading station to the unwinding station, said first and second wheel means being movable along said first and second tracks under the influence of gravity during movement of the first roll from the loading station to the unwinding station, said third and fourth wheel means being movable along said first and second tracks under the influence of gravity during movement of the second roll from the loading station to the unloading station.

67. An apparatus as set forth in claim 66 wherein said drive means is operable to move the empty core of the first roll from the unwinding station to the loading station with said first and second wheel means spaced from said first and second tracks and with said third and fourth wheel means in engagement with said first and second tracks.

68. An apparatus as set forth in claim 63 wherein said drive means includes means for pivoting said frame means about said second end portion of said frame means to move the empty core of the first roll and the first end portion of said frame means away from said unwinding station to an intermediate location above the loading station while the second roll remains stationary at the loading station, and for pivoting said frame means about the second end portion of said frame means as the second roll moves from the loading station toward the unwinding station to move said first end portion of said frame means and the empty core of the first roll downwardly from the intermediate location to the loading station.

69. An apparatus as set forth in claim 63 wherein said drive means is operable to pivot said frame means about the second end portion of said frame means to move the first end portion of said frame means and the empty core of the first roll from the unwinding station toward the loading station, said drive means being operable to pivot said frame means about the first end portion of said frame means to move the second end portion of said frame means and the empty core of the second roll from the unwinding station toward the loading station.

70. An apparatus as set forth in claim 63 wherein the second end portion of said frame means and empty core of one of the rolls is movable downwardly toward the loading station during pivotal movement of said frame means about the first end portion of said frame means and the first end portion of said frame means and empty core of one of the rolls is movable downwardly toward the loading station during pivotal movement of said frame means about the second end portion of said frame means.

71. An apparatus as set forth in claim 63 wherein said frame means includes a first longitudinal member extending between the first and second end portions of said frame means, and a second longitudinal member extending between the first and second end portions of said frame means, said first and second members extending parallel to each other and being spaced apart from each other by a distance which is at least as great as the axial extent of one of the rolls to enable the rolls to be sequentially positioned between said first and second members.

72. An apparatus as set forth in claim 71 further including first fulcrum means connected with a central portion of said first member and second fulcrum means connected with a central portion of said second member, said first and second fulcrum means at least partially supporting said first and second members when the first end portion of said frame means is at the unwinding station and at least partially supporting said first and second members when the second end portion of said frame means is at the unwinding station.

73. An apparatus as set forth in claim 71 further including a base, said drive means including a first drive arm having one end portion pivotally connected with said base and another end portion connected with a central portion of said first member, a second drive arm having one end portion pivotally connected with said base and another end portion connected with a central portion of said second member, and motor means for pivoting said first and second drive arms relative to said base to rotate said first and second members relative to said base.

74. An apparatus as set forth in claim 63 wherein the core of each of the rolls is hollow, said first sensor means includes means for transmitting a beam into the first end portion of the core of each of the rolls in turn, said second sensor means including means for transmitting a beam into the second end portion of the core of each of the rolls in turn.

* * * * *